US007510750B2

(12) United States Patent
Koga et al.

(10) Patent No.: US 7,510,750 B2
(45) **Date of Patent: *Mar. 31, 2009**

(54) RECORDING PAPER AND IMAGE RECORDING METHOD

(75) Inventors: Chizuru Koga, Ebina (JP); Kiyoshi Hosoi, Ebina (JP); Takashi Ogino, Ebina (JP); Tsukasa Matsuda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/013,803

(22) Filed: Dec. 17, 2004

(65) Prior Publication Data

US 2005/0244592 A1 Nov. 3, 2005

(30) Foreign Application Priority Data

Apr. 28, 2004 (JP) ..... 2004-133246

(51) Int. Cl.
*B41M 5/00* (2006.01)

(52) U.S. Cl. ..... 428/32.11; 428/32.21; 428/32.29; 428/32.3; 428/32.31; 428/32.32; 428/32.38; 428/195.1; 162/175; 162/181.1; 162/182.2; 347/95; 347/100; 347/101; 347/105; 430/32

(58) Field of Classification Search ..... 428/32.11, 428/32.21, 32.29, 32.3, 32.31, 32.32, 32.38, 428/195.1; 430/32; 347/95, 100, 101, 105; 162/175, 181.1, 182, 2

See application file for complete search history.

(56) References Cited

U.S. PATENT DOCUMENTS

| | | | | |
|---|---|---|---|---|
| 5,142,327 | A * | 8/1992 | Kahle | 399/160 |
| 5,190,563 | A | 3/1993 | Herron et al. | |
| 5,541,002 | A | 7/1996 | Hosoi et al. | |
| 5,589,277 | A | 12/1996 | Malhotra | |
| 5,757,408 | A | 5/1998 | Malhotra | |
| 5,882,754 | A | 3/1999 | Kuroyama et al. | |
| 5,922,910 | A | 7/1999 | Labat et al. | |
| 6,221,198 | B1 * | 4/2001 | Gryska et al. | 156/325 |
| 6,383,612 | B1 | 5/2002 | Waller, Jr. et al. | |
| 6,786,586 | B2 * | 9/2004 | Koga et al. | 347/95 |
| 6,800,429 | B2 * | 10/2004 | Lelental et al. | 430/502 |
| 2003/0048344 | A1 | 3/2003 | Koga et al. | |
| 2003/0141487 | A1 * | 7/2003 | Lelental et al. | 252/500 |
| 2003/0188838 | A1 | 10/2003 | Yancey et al. | |
| 2003/0192659 | A1 | 10/2003 | Yancey et al. | |
| 2003/0234846 | A1 * | 12/2003 | Koga et al. | 347/100 |
| 2004/0121093 | A1 | 6/2004 | Ogino et al. | |

FOREIGN PATENT DOCUMENTS

| | | |
|---|---|---|
| CN | 1352599 | 6/2002 |
| JP | A-61-74880 | 4/1986 |
| JP | A 7-257017 | 10/1995 |
| JP | A 8-216498 | 8/1996 |
| JP | 8-244335 | 9/1996 |
| JP | A 9-176995 | 7/1997 |
| JP | A-9-290556 | 11/1997 |
| JP | A-10-86527 | 4/1998 |
| JP | A 10-100531 | 4/1998 |
| JP | A 10-166713 | 6/1998 |
| JP | A 2002-96547 | 4/2002 |
| JP | A-2002-144719 | 5/2002 |
| JP | A 2002-154270 | 5/2002 |
| JP | A 2002-166644 | 6/2002 |
| JP | A 2003-011492 | 1/2003 |
| JP | A-2004-114627 | 4/2004 |
| WO | WO 99/06219 | 2/1999 |
| WO | WO 00/44568 | 8/2000 |

* cited by examiner

*Primary Examiner*—Betelhem Shewareged
(74) *Attorney, Agent, or Firm*—Oliff & Berridge, PLC

(57) ABSTRACT

A recording paper containing pulp fibers and filler as main components and containing at least a heterocyclic carboxylic acid and a water-soluble polymer in the surface of the recording paper, wherein the surface contains at least one kind of cationic substance selected from the group consisting of a cationic organic molecule and a metal salt containing a metal cation of valency two or greater.

19 Claims, No Drawings

RECORDING PAPER AND IMAGE RECORDING METHOD

CROSS-REFERENCE TO RELATED APPLICATION

This application claims priority under 35 USC 119 from Japanese Patent Application No. 2004-133246 the disclosure of which is incorporated by reference herein.

BACKGROUND OF THE INVENTION

1. Field of the Invention

The present invention relates to a recording paper and an image recording method thereof. In particular, the invention relates to a recording paper using so-called plain paper without coating layers containing substantial quantity of pigment on either surface thereof, and an image recording method for ink-jet printing and electrophotographic printing using the same.

2. Description of the Related Art

An image forming machine using an ink-jet printing method has characteristics such as: ease of coloring, low energy consumption, low noise generation during recording; and the ability to suppress production costs to low levels. Due to such advantages, image forming machines using ink-jet printing methods have become widely used in offices in recent years, with increases in the number of machines which use ink-jet printing methods combined with electrophotographic image recording machines such as laser printers and copy machines.

Recording media (recording paper) such as so-called plain paper, coated paper and glossy paper, white film, and transparent film are used in image forming with ink-jet printing methods. Particularly when an image forming machine using ink-jet printing methods is employed in an image forming machine of an electrophotographic printing method, such as a laser printer or copier in an office or the like, printing is conducted most often on plain paper. Among these machines most use plain paper, on which an image can be formed easily, which is readily available and at a low cost.

Therefore, enhancing the suitability for recording of plain paper image forming with ink-jet printing methods is extremely important. However, there have been the following problems when printing is conducted on plain paper in conventional image forming with ink-jet printing methods.

(1) A so-called feathering phenomenon occurs whereby ink flows out along fibers of plain paper. Feathering significantly deteriorates image quality, particularly the quality of printed characters/letters.

(2) So-called plain paper usually contains a sizing agent on the surface for making the surface water-repellent. Consequently, absorption of ink is delayed, causing so-called inter-color bleeding (ICB) at portions where different colors contact with each other.

(3) Since absorption of ink is delayed due to the water repelling properties of plain paper surfaces, faces which contact with printed surfaces become dirty when printed documents are stacked.

(4) Since colorants in ink hardly stay on the surface of plain paper, the coloring nature of color ink is inadequate.

(5) Since colorants in inks permeate into plain paper, printed images can be seen through from the back of plain paper—rendering double-sided printing impossible.

Ink-jet printers have attempted to produce high printing speed, comparable to that of laser printers, in accordance with an expanded market for ink-jet printer in the office. However it has been very difficult to attain improved permeability (dryability) and image quality whilst also the ability to carry out double-sided printing.

In the light of these problems, methods of promoting coagulation and sedimentation of components contained in the ink by surface treating pape with cationic substances such as cation polymers, polyvalent metallic salts or the like are proposed. Of these methods, a method of adding a substance (usualy a polymer) to inks which reacts with a cationic substance applied to the surface of paper, thereby enhancing the viscosity of the ink applied thereto, is particularly useful for improving image quality. This is because the non-uniform spread-out rates of colorants contained in ink when ink is applied to paper surfaces can be controlled when high viscosity is obtained.

However, when the acid value of the polymer described above is large (equivalent to the amount of the anionic hydrophilic groups reacting with the cationic substance), the viscosity of the ink is raised excessively, the jetting performance of the ink jetted out from the recording head, or permeability of the ink into the paper may be damaged. On the other hand, when the acid value is small, the polymer is in a state of emulsion, and the increase in the viscosity of the ink is suppressed. Thus the jetting performance can be secured. However, since the number of reacting groups contributing to the acid value is few in the polymer, the reactivity with the cationic substance contained on the surface of the paper becomes low, and large improvements in image quality can not then be obtained.

On the other hand, in parallel to the improvements of ink composition described above, diversification in colorants has progressed in recent years, and, in addition to dyes widely used conventionally, pigments are being used more and more often in color inks. Thereby, situations where ink-jet printers using dye based inks and ink-jet printers using pigment based inks live together in the same office has come about.

When colorants are dyes and when colorants are pigments, generally the following respective methods are used effectively for raising image quality with recording papers designed for ink-jet printing.

When the colorant is a dye, a method is mentioned whereby the dye is reacted with a cationic substance contained on the surface of the paper, forming an insoluble dye complex, which is then physically trapped on the surface of the paper, is mentioned.

When the colorant is a pigment, a method is mentioned whereby a low molecule cationic substance contained on the surface of the paper rapidly elutes into the ink applied to the surface of the paper. This has the effect of rapidly raising the the concentration of electrolytes in the ink, coagulating the pigment as a pigmented colloid and fixing the pigment on the surface of the paper.

In order to obtain the full improvement effects in image quality with both dyes and pigments, it is necessary to include on the surface of the paper large amounts of both low molecule cations having fast elution, and polymers having good low molecule fixing performance.

However, a paper containing large amounts of substances having strong ionicity on the surface may overreact to surrounding environmental changes, and the electric resistivity of the paper may be reduced. Therefore, when such paper is used for image formation using electrophotographic printing methods in laser printers and the copy machines or the like, the paper has a bad influence on the transferability of toner. This means that such paper is not suitable for image formation using electrophotographic printing methods. Therefore, it is necessary to use a different paper for each printer having different image forming methods in the office (for example, see Japanese Patent Application Laid-Open (JP-A) Nos. 10-166713, 7-257017, 8-216498 and 10-100531).

When ink containing a component which reacts with cationic substances contained on the surface of the paper, to become insoluble, is used for image formation, when the ink is applied to the surface of the paper, huge coagulates containing the colorant are formed. This gives a significant improvement in image quality. However, in practice, components having sufficient reactivity to cationic substances are restricted to polymers having significant numbers of hydrophilic groups. Even if ink containing these components is used for image formation, when the ink is applied to the surface of the paper, the viscosity of the ink is increased. Thereby, not only fast drying properties needed for high-speed printing, but also ink jetting performance may suffer (for example, see Japanese Patent Application Laid-Open (JP-A) Nos. 9-176995 and 2002-96547).

SUMMARY OF THE INVENTION

The present invention has been made in view of the above circumstance and provides a recording paper, and an image recording method using the recording paper. That is, the invention provides a recording paper which can be jointly used for both ink-jet printing methods and electrophotographic printing methods. In ink-jet printing methods, the recording paper is: applicable to high-speed printing, regardless of the type of the colorants; provides fast ink drying; provides high image density in the obtained images; gives little feathering and inter-color bleeding; and gives a low density of see-through. In electrophotographic printing methods, the change of electric resistivity of the recording paper due to the environment is small and it provides excellent transferability. And the invention provides an image recording method using such a recording paper.

The present invention has been made in view of the above circumstances and provides the following.

According to an aspect of a recording paper of the invention, there is provided a recording paper containing pulp fibers and filler as main components and containing in a surface of the recording paper at least a heterocyclic carboxylic acid and a water-soluble polymer, wherein the surface also contains at least one kind of cationic substance selected from the group consisting of a cationic organic molecule and a metal salt containing a metal cation of valency two or greater.

Further, the invention provides the following.

According to a first aspect of an image recording method of the invention, there is provided an ink-jet image recording method for forming an image by applying a droplet of ink containing a colorant and at least one kind of solvent selected from the group consisting of water and a water-soluble organic solvent to a surface of a recording paper. Wherein the recording paper contains pulp fibers and filler as main components and contains at least a heterocyclic carboxylic acid and a water-soluble polymer in a surface of the recording paper, and wherein the surface of the recording paper also contains at least one kind of cationic substance selected from the group consisting of a cationic organic molecule and a metal salt containing a metal cation of valency two or greater.

Further, the invention provides the following.

According to a second aspect of an image recording method of the invention, there is provided a method of electrophotographically recording an image, which includes: uniformly charging a surface of an electrostatic latent image support; exposing the surface of the electrostatic latent image support to light, to thereby form an electrostatic latent image; developing the electrostatic latent image formed on the surface of the electrostatic latent image support, using an electrostatic image developer, to form a toner image; transferring the toner image onto a surface of a recording paper containing pulp fibers and filler as main components, and containing in the surface of the recording paper at least a heterocyclic carboxylic acid and a water-soluble polymer; and fixing the toner image transferred onto the surface of the recording paper. In this method the surface of the recording paper also contains at least one kind of cationic substance selected from the group consisting of a cationic organic molecule and a metal salt containing metal cation of valency two or greater.

DETAILED DESCRIPTION OF THE INVENTION

<Recording Paper>

The recording paper of the present invention contains pulp fibers and filler as main components and contains at least a heterocyclic carboxylic acid and a water-soluble polymer in a surface of the recording paper, wherein the surface also contains at least one kind of cationic substance selected from the group consisting of a cationic organic molecule and a metal salt containing a metal cation of valency two or greater.

It is particularly preferable that the recording paper of the invention, having a base paper containing pulp fibers and filler as main components, is produced by applying a treatment solution containing at least a heterocyclic carboxylic acid and a water-soluble polymer onto a surface of the base paper. In this case the treatment solution contains at least one kind of cationic substance selected from the group consisting of a cationic organic molecule and a metal salt containing a metal cation of valency of two or greater.

It is preferable that the recording paper of the invention is what is called a "plain paper" and does not have a coated layer containing substantial quantity of pigment formed on either surface thereof. In this case, there is no substantial quantity of pigment in the treatment solution. However, the term "no substantial quantity of pigment" means that the proportion of the pigment contained in the treatment solution is 10 percent by mass or less.

The recording paper of the invention does not use on its own a substance of at least one kind of cationic substance selected from the group consisting of a cationic organic molecule and a metal salt containing a metal cation of valency two or greater. Instead this invention uses a combination of the above cationic substance and a heterocyclic carboxylic acid. (Hereinafter, especially where there is no further explanation, the term "cationic substance" does not mean all the substances having cationy in the broad sense but rather a cationic organic molecule or a metal salt containing a metal cation of valency two or greater).

Specific examples of cationic substances will be described later. Since these substances have strong ionicity, when large amounts of cationic substances are contained on a paper surface, as described before, the electric resistivity of the paper is changed excessively by environmental changes, and thereby transferability becomes inferior.

On the other hand, if a heterocyclic carboxylic acid is used without using a cationic substance, cationic substances having the above described failings, then the speed for agglutinating and/or insolubilizing colorants of pigment colloids and dye molecules is somewhat inferior to when using a cationic substance. Therefore, although the image density is improved, there exists the problem that exudation which occurs in a short period of time, such as feathering and ICB, cannot be fully controlled.

However, if a cationic substance and a heterocyclic carboxylic acid having weak ionicity are used in combination, the amount of cationic substance used (the amount contained on the paper surface) can be controlled. Thereby, the electric resistivity of the paper is not excessively fluctuated by changes in the environment and when an image is formed using an electrophotographic printing method, improved transferability can be obtained.

When the recording paper of the invention, which combines the use of both substances, is printed using ink by an ink-jet printing method, as described below, regardless of the type of the colorant in the ink: fast drying of the ink can be achieved; the image density of images obtained can be made high; inter-color bleeding and feathering can be made rare; and see-through density can be made low.

The improvement in image quality described above when the colorant used for the ink is a dye, can be obtained due to the following mechanism.

That is, when ink using a dye is applied to a surface of the recording paper, first, the functional groups of the cationic substance which exist at the surface of the recording paper undertake ionic-dissociatiation, cationizing (becoming cationic groups). Then, because the cationic groups of the cationic substance react with the dye to form a complex, and the complex is trapped by the water-soluble polymer. As a result, image density can be raised, and image quality can be improved.

When the colorant used for the ink is a pigment, the improvement in image quality described above can be obtained due to the following mechanism.

When ink using a pigment is applied to a surface of the recording paper, ions of the cationic substance existing on the surface of the recording paper dissociate, and the the concentration of electrolytes in the ink at the surface of the recording paper rises, and the pigment is coagulated as a pigment colloid.

At the same time, the heterocyclic carboxylic acid existing at the surface of the recording paper also promptly elutes into the ink at the surface of the recording paper, and shows a high degree of electrolytic dissociation, due to the resonance structure of the heterocyclic carboxylic acid. Therefore, the heterocyclic carboxylic acid raise the carboxyl ion density in the ink applied to the surface of the recording paper and in doing so make insoluble carboxyl groups which are functional groups existing on the surface of the pigment and carboxyl groups which are in other components of the ink than the pigment.

Thus, since both the cationic substance and the heterocyclic carboxylic acid have a high capability for efficiently agglutinating and insolubilizing components constituting ink, such as pigments and the like, the above described effect can be obtained.

Also, from viewpoints other than that of the colorants used for the ink as described above, particularly when ink having high penetration to the recording paper is used, since inter-color bleeding and feathering can be more effectively prevented, exceptional superior image quality can be obtained.

When the ink containing an anionic polymer is used, the carboxyl group, contained as a hydrophilic group of the anionic polymer, can be insolubilized. By doing this huge coagulates containing colorant can be formed and the image quality can be dramatically raised with respect to feathering, inter-color bleeding and color reproducibility.

-Base Paper-

Next, the base paper used for the recording paper of the invention will be described.

The base paper used for the recording paper of the invention contains pulp fibers and filler as main components.

Examples of pulp fibers include chemical pulp. Specific preferable examples include hardwood bleached kraft pulp, hardwood unbleached kraft pulp, softwood bleached kraft pulp, softwood unbleached kraft pulp, hardwood bleached sulfite pulp, hardwood unbleached sulfite pulp, softwood bleached sulfite pulp, softwood unbleached sulfite pulp and the like, as well as pulp produced by chemically treating raw fibers from wood, cotton, hemp, bast and the like.

Other examples of pulps include: ground wood pulp, produced through mechanical treatment from timber or wood chips; chemi-mechanical pulp, produced through mechanical treatment of timber or wood chips that have been preliminarily impregnated with a chemical agent; and, thermo-mechanical pulp, produced by softening timber or wood chips in a steam digester, followed by use of a refiner to achieve a pulp state. Other examples include chemi-thermo mechanical pulp having a high yield. These virgin pulps may be singly used or, as appropriate, mixed with recycled pulp.

In particular virgin pulp is preferably subjected using a bleaching treatment using chlorine dioxide without the use of chlorine gas (Elemental Chlorine Free; ECF bleaching method) or a bleaching treatment mainly using ozone/hydrogen peroxide without using any chlorine containing compound (Totally Chlorine Free; TCF bleaching method).

Furthermore, for the raw materials of recycle pulp may be used: non-printed waste paper having grades of best white, special white, medium white and off white and the like obtained as off-cuts, broke, and trim-off generated in bookbinding factories, printing factories, converting factories and the like; recycled wood-free paper such as wood-free coated paper, wood-free paper and the like on which printing or copying has been performed; recycled paper printed thereon with aqueous ink, oil-based ink or pencil; recycled newspapers, including leaflets which have been printed on medium quality paper, medium quality coated paper, wood-free paper, wood-free coated paper, and the like; and waste papers including medium quality paper, medium quality coated paper, ground wood papers and the like.

In cases where recycle pulp is used for the base paper in the invention, the raw material for the waste paper is preferably subjected to an ozone bleaching treatment and/or a hydrogen peroxide bleaching treatment. In order to obtain recording paper exhibiting high brightness, it is preferable that in a recycled pulp the mixing proportion of pulp obtained by the above bleaching treatments is within the range from 50 percent by mass to 100 percent by mass. In addition, from the viewpoint of recycling natural resources, it is more preferable that a mixing proportion in the waste paper pulp is within the range from 70 percent by mass to 100 percent by mass.

Ozone treatments have a function of breaking down fluorescent dyes and the like which generally are contained in wood-free paper. Hydrogen peroxide treatments have a function of preventing yellowing caused by alkalis used in deinking. Combined treatment using both bleaching systems not only facilitates the removal of ink from waste paper, but also the brightness of the treated pulp is further enhanced. Moreover, through breaking down and removing residual chlorine-containing compounds in pulp, these treatments are very effective in reducing the organic halide content of waste paper produced from chlorine-bleached pulp.

Further, in addition to the pulp fibers of the base paper used for the invention is added filler in order to adjust opacity; brightness and surface quality. In cases where a decrease in halogen content in the recording paper is desired, it is preferable to use a halogen free filler.

Examples of fillers include: inorganic pigments such as calcium carbonate heavy, calcium carbonate light, chalk, kaolin, calcinated clay, talc, calcium sulfate, barium sulfate, titanium dioxide, zinc oxide, zinc sulfide, zinc carbonate, aluminum silicate, calcium silicate, magnesium silicate, synthetic silica, aluminum hydroxide, alumina, sericite, white carbon, saponite, calcium montmorillonite, sodium montmorillonite, bentonite and the like; and organic pigments such as acrylic type plastic pigment, polyethylene, chitosan particles, cellulose particles, polyamino acid particles, urea resin and the like.

Also, in cases where recycled pulp is incorporated in the base paper, the ash content in the raw waste paper must be estimated in advance and the amounts of additives adjusted accordingly.

Although the mixing proportion of the filler is not particularly restricted, the mixing proportion is preferably in a range of between 1 and 80 parts by mass relative to pulp fiber of 100 parts by mass, and more preferably between 1 and 50 parts by mass.

In making pulp fiber to obtain the base paper, it is preferable to adjust the fiber orientation ratio of the base paper to within in a range of 1.0 to 1.55, more preferably to within in a range of 1.0 to 1.45, and still more preferably to within in a range of 1.0 to 1.35. If the ratio is within the range of 1.0 to 1.55 it is possible to reduce curling of the recording paper after the paper is printed using an ink-jet printing method.

Fiber orientation ratio refers to a fiber orientation ratio measured by using ultrasonic transmission speed method, and indicates a value obtained by dividing the ultrasonic transmission speed in the MD (the direction of progression in the paper machine—machine direction) by the ultrasonic transmission speed in the CD (the direction perpendicular to the machine direction—cross machine direction). Fiber orientation ratio is expressed by the following equation (1).

Equation (1)fiber orientation ratio ($T/Y$ ratio) of the base paper=MD direction ultrasonic transmission speed/CD direction ultrasonic transmission speed More specifically, the required fiber orientation ratio, using the ultrasonic transmission speed method, can be measured using, for example, a Sonic Sheet Tester (manufactured by Nomura Shoji Co., Ltd.).

-Cationic Substance-

Next, the cationic substances used for the invention will be described.

As the cationic substance used for the invention, a cationic organic molecule as a polyvalent cation, and/or at least one kind of metal salt containing a metal cation of valency of two or greater can be used.

Examples of cationic organic molecules include copolymers of a hydrophilic monomer component having a primary amino group, secondary amino group, tertiary amino group or a quaternary ammonium group, with a hydrophobic monomer component, or a salt thereof. If necessary, other components may be copolymerized. The copolymer may be a random polymer, a graft polymer, a block polymer, or the like.

Examples of hydrophobic monomer components include styrene, styrene derivatives, vinyltoluene, vinyltoluene derivatives, vinylnaphthalene, vinylnaphthalene derivatives, butadiene, butadiene derivatives, isoprene, isoprene derivatives, ethylene, ethylene derivatives, propylene, propylene derivatives, alkyl ester of acrylic acid, and alkyl ester of methacrylic acid.

Of these, preferred hydrophobic monomer components are styrene, styrene derivatives, alkyl acrylates, and alkyl methacrylates. The number of carbon atoms of the alkyl group contained in the hydrophobic monomer components is preferably in a range of 1 to 10 and more preferably in a range of 1 to 6.

Examples of the other components include acrylamide, acrylamide derivatives, dimethylaminoethyl methacrylate, ethoxyethyl methacrylate, butoxyethyl methacrylate, ethoxytriethylene methacrylate, vinylpyrrolidone, vinylpyridine, and polyoxyethylene-containing components such as alkyl ether, methoxypolyethylene glycol methacrylate, and polyethylene glycol methacrylate, and hydroxyl group containing components such as hydroxymethyl methacrylate, hydroxyethyl methacrylate, and vinyl alcohol.

Examples of the hydrophilic monomers having a primary, secondary, or tertiary amino group, or a quarternary ammonium group include nitrogen-containing compounds such as N,N-dimethylaminoethyl methacrylamide, N,N-dimethylaminoethyl acrylamide, N,N-dimethyl acrylamide, N,N-dimethyl methacrylamide, N,N-dimethylaminopropyl acrylamide, N,N-dimethylaminopropyl methacrylamide, and compounds obtained by quaternarizing the amino groups of the nitrogen-containing compounds.

Methyl chloride, methyl iodide, dimethyl sulfate, benzyl chloride, epichlorohydrin, and the like can be used for quaternarizing the amino groups of the nitrogen-containing compounds.

Multi-valent cationic compounds which include in their structures primary, secondary, or tertiary amine salts, and quaternary ammonium salts can be also be used as a cationic molecular organic compound. Examples thereof include dodecyltrimethylammonium chloride, dodecylbenzyltrimethylammonium chloride, dodecyldimethylbenzylammonium chloride, stearyltrimethylammonium chloride, benzyltributylammonium chloride, benzalkonium chloride, cetyltrimethylammonium chloride, an ethylene oxide adduct of higher alkylamine (e.g., dihydroxyethylstearylamine) as an amine salt, pyridinium salt type compounds (e.g., cetylpyridinium chloride, cetylpyridinium bromide, and the like), imidazoline-type cationic compounds (e.g., 2-heptadecenylhydroxyethylimidazoline and the like). Alternatively, a so-called cationic surfactant may also be used.

Among these cationic organic molecules, a functional group showing cationic properties of the cationic organic molecule is preferably an quarternary ammonium group, and/or the weight average molecular weight of the cationic organic molecule is preferably in a range of 100 to 10000. This is because particularly the quarternary ammonium group has high complex ion formation ability with a sulfonic group as a surface functional group of the dye.

When the weight average molecular weight exceeds 10000 and the ink is applied to the surface of the recording paper, the elution of the cationic organic molecule into the ink from the surface of the recording paper may become slow, and the insolubility and/or agglutination of the ink colorant may become inadequate.

On the other hand, known metal salts can be used as the metal salt containing metal cation of valency two or greater. As the metal cation of valency two or greater, aluminum, beryllium, calcium, magnesium, strontium, barium and radium are preferable, and calcium and magnesium are more preferable.

Since these metal cations have a small molecular weight, they are easily eluted into the ink applied to the surface of the recording paper and the hydration time when ionized is short, so a colorant which is generally an anionic substance can be promptly agglutinated and/or insolubilized.

Particularly, in an ink-jet printer performing high-speed printing, in order to enhance ink drying of the ink, ink having high penetration is used. In this case, unless the colorant can be promptly agglutinated and/or insolubilized, image quality cannot be enhanced. However, if a metal salt containing a metal cation of valency two or greater is used in such a case, the image quality can be raised.

-Heterocyclic Carboxylic Acid-

The heterocyclic carboxylic acid is not particularly limited as long as the heterocyclic carboxylic acid is obtained by binding a carboxyl group to a heterocycle. Examples thereof include a carboxylic acid having a furan structure such as 2-furan carboxylic acid, 3-furan carboxylic acid, 5-methyl-2 furan carboxylic acid, 2,5-dimethyl-3-furan carboxylic acid, 2,5-furan dicarboxylic acid, 2-(2-furyl)acrylic acid and furilic acid; a carboxylic acid having a hydrofuran structure such as butyrolactone-beta-carboxylic acid, 4-methyl-4-pentanolide-3-carboxylic acid, 4-methyl-4-pentanolide-3-acetic acid and 3-butene-4-oride-3-carboxylic acid; a carboxylic acid having a pyran structure such as 2-benzofuran carboxylic acid, 2-pyron-6-carboxylic acid, 4-pyron-2-carboxylic acid, 5-hydroxy-4-pyron-2-carboxylic acid, 4-pyron-2,6-dicarboxylic acid, 3-hydroxy-4-pyron-2,6-dicarboxylic acid; a carboxylic acid having a pyrrolidine structure such as coumarinic acid, thiophenecarboxylic acid, 2-alpha-pyrrole carboxylic acid, 2-beta-pyrrole carboxylic acid, pyrrole-N-carboxylic acid, 2,3-dimethylpyrrole-4-propionic acid, 2,4,5-trimethylpyrrol-3-propionic acid, 2,5-dioxole-4-methyl-3-pyrroline-3-propionic acid, 2-pyrrolidine carboxylic acid (proline), 4-hydroxyproline, 1-methylpyrrolidine-2-carboxylic acid, 2-pyrrolidone carboxylic acid (PCA), and 5-carboxy-1-methylpyrrolidine-2-acetic acid; a carboxylic acid having an indole structure such as 3-hydroxy-2-indole carboxylic acid, 3-indole carboxylic acid, 3-indoleacetic acid, tryptophan and N-methyl tryptophan; pyridinesubstitution derivatives such as 2-pyridinecarboxylic acid, 3-pyridinecarboxylic acid, 4-pyridinecarboxylic acid, 2,3-pyridinedicarboxylic acid, 2,4-pyridinedicarboxylic acid, 2,5-pyridinedicarboxylic acid, 2,6-pyridinedicarboxylic acid, 3,4-pyridinedicarboxylic acid, 3,6-pyridinedicarboxylic acid, 2,3,4-pyridinetricarboxylic acid, 2,3,5-pyridinetricarboxylic acid, 2,4,5-pyridinetricarboxylic acid, 3,4,5-pyridinetricarboxylic acid, pyridine pentacarboxylic acid, 1,2,5,6-tetrahydro-1-methylnicotinic acid; a carboxylic acid having a quinoline structure such as 2-quinolinecarboxylic acid, 4-quinolinecarboxylic acid, 2-phenyl-4-quinolinecarboxylic acid, 2,3-quinolinedicarboxylic acid, 4-hydroxy-2-quinolinecarboxylic acid, and 6-methoxy-4-quinolinecarboxylic acid. However, examples are not limited thereto.

The solubility of the heterocyclic carboxylic acid is preferably in a range of 0.1 g to 10 g, and more preferably in a range of 4 g to 8 g. The term "solubility" means the amount of the maximum dissolution based on 100 g of pure water at 20° C.

Among the heterocyclic carboxylic acids listed above, particularly preferably used are at least one selected from the group consisting of pyrrolidone carboxylic acid, coumarinic acid, furan carboxylic acid, pyrrole carboxylic acid and pyridine pentacarboxylic acid. Since the solubility of these heterocyclic carboxylic acids is high and the heterocyclic carboxylic acids show a high degree of electrolytic dissociation, due to their resonance structure, when eluted in ink, these heterocyclic carboxylic acids are very effective in enhancing the density of carboxyl ions in the ink. Therefore, the action of insolubilizing the carboxyl group contained as a hydrophilic functional group of the pigment and ink composition components other than the pigment is great.

-Water-Soluble Polymer-

There is not any specific limitation as to the water-soluble polymer, and any well known water-soluble polymers can be used. Examples thereof include cellulose derivatives such as carboxymethyl cellulose, hydroxyethyl cellulose and cation-modified cellulose, PVA and its derivatives such as curdlan, polyvinyl alcohol, and cation-modified polyvinyl alcohol, starches such as cationized starch, oxidized starch, anionized starch and hydrophobic group introduced starch, and resins having high water absorptivity such as polyacrylic acid.

-Method for Manufacturing a Recording Paper and Various Characteristics and the Like Thereof- Next, a method for manufacturing the recording paper of the invention, preferable characteristics and the like will be described below. Although a method of applying the treatment solution containing the cationic substance, the heterocyclic carboxylic acid and the water-soluble polymer on the surface of the base paper is not particularly limited, usually it is preferable that a treatment solution is used as a coating solution (size press liquid), and a method for performing size press processing to the surface of the base paper is used.

As described above, it is preferable that the treatment solution excludes substantial quantity of pigment (the mixing proportion of the pigment in the treatment solution is 10% by mass or less.). In other words, it is preferable that the recording paper of the invention on which the surface treatment is carried out is a plain paper which does not have a coated layer containing substantial quantity of pigment on the surface, such as, that which is generally called a coated paper. Generally, a coated paper having a coated layer containing pigment on the surface of the recording paper is not so preferable in the invention in the view of the cost, and the effects of scratches in conveyance members and paper dust and the like when the recording paper is used in the office for electrophtographic and ink-jet recording.

A coating solution can be coated on the surface of the base paper by ordinary coating units such as a size press, shim size, gate roll, roll coater, bar coater, air knife coater, rod blade coater, and blade coater. A drying process can be applied to the base paper to which the cationic substance, the heterocyclic carboxylic acid and the water-soluble polymer are coated to form the recording paper of the invention.

In the invention, in cases where the cationic substance, the heterocyclic carboxylic acid and the water-soluble polymer are applied onto the surface of the base paper, it is preferable that the total treatment amount per side of the base paper is in a range of 0.5 to 6 g/m$^2$ in terms of solid content remaining (togal solid content), and more preferably 0.5 to 3 g/m$^2$.

If the total treatment amount exceeds 5 g/m$^2$, the texture of what is called a plain paper may be lost. Therefore, the total treatment amount of the cationic substance, heterocyclic carboxylic acid and water-soluble polymer applied on the surface of the base paper is preferably in a range of 0.6 to 5 g/m$^2$.

The compounding ratio of the cationic substance to the heterocyclic carboxylic acid in the treatment solution (the mass ratio of the solids content), that is, cationic substance: heterocyclic carboxylic acid is preferably in a range of 1:5 to 5:1, and more preferably 2:3 to 3:2.

It is preferable that the treatment amount per side of the cationic substance onto the surface of the base paper is in a range of 0.1 to 3 g/m$^2$ in terms of solid content remaining, and the treatment amount per side of the heterocyclic carboxylic acid is in a range of 0.1 to 3 g/m$^2$ in terms of solid content remaining.

If the treatment amount of the cationic substance and the heterocyclic carboxylic acid (solid content) is less than 0.1 g/m$^2$, the increase in density of the carboxyl ions, when the ink is applied to the surface of the recording paper, is inadequate and the cation equivalent is few. Thus, deterioration of image quality such as reduced density, aggravation of feathering, aggravation of ICB and worsening of color reproducibility may result.

If the treatment amount of the cationic substance and the heterocyclic carboxylic acid (solids content) exceeds 3 g/m$^2$, as a result, the total treatment amount of the cationic substance, heterocyclic carboxylic acid, and water-soluble polymer applied on the surface of the base paper may exceed 5/m$^2$, and the texture of that which is called a plain paper may be lost.

The degree of sizing of the recording paper can be adjusted by the amount and/or the type of above binders to achieve the value necessary in the invention. However, when the adjustment of the degree of sizing is not carried out sufficiently by the binder alone, a surface sizing agent may be used.

Examples of surface sizing agents that can be used include rosin sizing agents, synthetic sizing agents, petroleum resin sizing agents, neutral sizing agents, starch, and polyvinyl alcohol.

In a slurry preparation stage in the paper-making process, the degree of size may be adjusted in advance by mixing in an internal sizing agent. It is preferable to use a halogen-free internal sizing agent or surface sizing agent if a reduction of halogen content in the recording paper is desired. More specifically, rosin sizing agents, synthetic sizing agents, petroleum resin sizing agents, neutral sizing agents and the like can be used.

The sizing agent may be used with the fixing agent of the pulp fiber. In this case, aluminum sulfate, a cationized starch or the like can be used as the fixing agent. It is preferable to use a neutral sizing agent from the standpoint of enhancing the preservability of the recording paper. The degree of sizing can be adjusted by the amount of the sizing agent added.

The Stockigt sizing degree of the recording paper used for the invention is preferably 10 to 60 seconds, and more preferably 15 to 30 seconds. If the Stockigt sizing degree is less than 10 seconds, the ability of the recording paper to be practically used in ink-jet printing is impaired because the degree of feathering becomes so bad that fine characters become indiscernible and printed bar codes become unreadable.

On the other hand, if the corrected Stockigt sizing degree degree exceeds 60 seconds, inter-color bleeding occurs and color image quality becomes poor because ink penetration becomes retarded. In addition, the drying characteristics of the ink may become inferior, and the marks may be generated on the back of the paper when high-speed printing.

The Stockigt sizing degree in the invention means the Stockigt sizing degree measured in accordance with JIS-P-8122:1976, the disclosure of which is incorporated herein by reference. This is undertaken in a standard environment (23° C. and 50% relative humidity) as specified in JIS-P-8111: 1998, the disclosure of which is incorporated herein by reference.

The recording paper of the invention can also be used in order to form an image by an electrophotographic printing method besides that of printing by the ink-jet printing method. In this case, the recording paper preferably has a smoothness of 20 to 100 seconds, and more preferably 70 to 100 seconds, from the standpoint of raising toner transferability and improving granularity. If the smoothness is less than 20 seconds, granularity may becomes inferior. On the other hand, a paper having a smoothness exceeding 100 seconds is not desirable as the recording paper because, in order to obtain high smoothness, a high-pressure press is employed to paper in a wet state when the paper is manufactured. As a result, the opacity of the recording paper may be reduced, or curling which occurs after printing in ink-jet printing may increase. The smoothness used in the invention means a value measured in accordance with JIS-P-8119: 1998, the disclosure of which is incorporated herein by reference.

The recording paper of the invention preferably has a formation index of at least 20, and more preferably at least 30, from the standpoint of improving image quality in electrophotographic recording by reducing cloudy mottles. If the formation index is less than 20, image quality may be impaired by mottles because the penetration of toner into the paper becomes non-uniform when toner is adhered by thermal fusion in electrophotographic recording.

The term "formation index" as used herein means a value obtained by measurement using a 3D Sheet Analyzer (M/K950) manufactured by M/K Systems, Inc. (MKS Corp.), in which the aperture of the analyzer is set to a diameter of 1.5 mm, and with a micro formation tester (MFT).

That is, the formation index is obtained by attaching a sample of the recording paper onto a rotatable drum in the 3D Sheet Analyzer with a light source disposed on the drum axis and a photodetector disposed outside the drum responsive to the light source., rotating and measuring, as differences in light amounts, local differences in basis weight in the sample.

The target area of the measurement in this case is set by the diameter of the aperture attached to the portion of the photodetector at which light enters. The differences in light amount (deviations) are then amplified, subjected to A/D conversion, and classified into 64 optically measured classes of basis weight. 1,000,000 pieces of data are taken per scan and histogram frequencies for the data are obtained. The maximum frequency (peak value) of the histogram is divided by the number of classes having a frequency of 100 or more corresponding to the 64 classes, divisions of basis weights. Thereafter the value is divided by 100. The value obtained in this procedure is defined as the formation index. The higher the formation index is, the better the texture is.

When using the recording paper of the invention as a recording medium corresponding to not only the ink-jet printing method but also to the electrophotographic printing method, the heat transfer method, it is preferable to mix an electronically conductive agent to adjust the surface electric resistivity of the recording paper. However, in order to reduce the halogen content in the recording paper, it is preferable to use an electronically conductive agent which does not contain a halogen.

As examples of electronically conductive agents the following can be used: inorganic electrolytes such as sodium sulfate, sodium carbonate, lithium carbonate, sodium metasilicate, sodium tripolyphosphate and sodium hexametaphosphate; anionic surfactants such as sulfonic acid salts, sulfate ester salts, carboxylate salts and orthophosphates; cationic surfactants; nonionic surfactants and ampholytic surfactants such as polyethylene glycol, glycerin and sorbitol; and polymer electrolytes can be used.

In order to control penetration of the coating solution into the base paper in the coating process for coating with a treatment solution containing the cationic substance, the heterocyclic carboxylic acid and the water-soluble polymer onto the surface of the base paper, it is preferable that the base paper, prior to coating, is subjected to calendering or the like to adjust the air permeability of the base paper to within a range of from 10 sec to 30 sec. This is due to the fact that if air permeability of base paper is high, the penetration of the coating solution into base paper might be suppressed. If air permeability of the base paper is excessively high, ink penetration can also be inhibited when printing is performed using the ink-jet printing system, leading to intercolor bleeding and poorer drying ability. Thereby it is preferred to adjust the air permeability of the base paper from these considerations.

For paper manufactured without using a size press process, another method which can be used for suppressing penetration of the coating solution into the base paper is to put the dry paper through a separate size press process, coating the base paper.

When the surface electric resistivity of at least the surface to be printed (printing surface) is measured by a method in accordance with JIS-K-6911, the disclosure of which is incorporated by reference herein, after storing for 8 hours or longer at a standard environment (23° C. and 50% relative humidity) as specified in JIS-P-8111:1998, it is preferable that the surface electric resistivity of the recording paper of the invention is in a range of $1.0\times10^{9}$ to $1.0\times10^{11}\Omega$, more preferably $5.0\times10^{9}$ to $7.0\times10^{11}\Omega$ and still more preferably $5.0\times10^{9}$ to $2.0\times10^{10}\Omega$. The term "printing surface" means the surface of the recording paper which contains the cationic substance, the heterocyclic carboxylic acid and the water-soluble polymer.

When the volume electric resistivity of the recording paper of the invention is measured by a method in accordance with JIS-K-6911 after storing for 8 hours or longer at a standard environment (23° C. and 50% relative humidity) as specified in JIS-P-8111:1998, it is preferable that the surface electric resistivity of the recording paper of the invention is in a range of $1.0\times10^{10}$ to $1.0\times10^{12}\Omega$-cm, more preferably $1.3\times10^{10}$ to $1.6\times10^{11}\Omega$-cm and still more preferably $1.3\times10^{10}$ to $4.3\times10^{10}\Omega$-cm.

The recording paper of the invention is produced by treating the surface of the base paper using a treatment solution containing a heterocyclic carboxylic acid. This helps to counteract the tendency of part of the solution wherein the cationic substance has a strong tendency to change surface electric resistivity and volume electric resistivity greatly in response to changes in the environment and to worsen transferability. Thereby, the surface electric resistivity and the volume electric resistivity can be adjusted easily within the above ranges.

<Method for Recording an Image of an Ink-Jet Printing Method>

Next, the method for recording an image of the ink-jet printing method (hereinafter, may be referred to as "ink-jet recording method") in the invention will be described. The ink-jet printing method in the invention prints using ink onto the recording paper of the invention. The ink is applied to a surface of the recording paper containing the heterocyclic carboxylic acid, the water-soluble polymer and the cationic substance. The ink used in this case is not particularly limited and any known ink may be used, however inks containing water and a colorant are preferable.

Herein, colorants used are not only dyes but also hydrophobic pigments used together with a pigment dispersing agent containing a hydrophilic group in order to be dispersed in the ink, and self dispersing pigments to be described below can be used. A known water-soluble organic solvent besides water can be used as a solvent, and a surfactant or the like and various additives or the like can be further contained as appropriate.

An ink containing a colorant having the hydrophilicity described above is suitably used. Examples of ink sets used when multi-color printing include an ink set provided with at least black ink, cyanogen ink, magenta ink and yellow ink, and it is preferable to mix water, a water-soluble organic solvent, a colorant and a surfactant or the like further to prepare these inks.

Each ink in the ink set contains water, a water-soluble organic solvent, a colorant, a surfactant, a water-soluble polymer or the like. When the pigment is used as a colorant, a self-dispersing pigment (pigment which can be dispersed in water containing no pigment dispersing agent) is used in many cases. The surface of the self-dispersing pigment contains a lot of functional groups (water-soluble groups) which enables the dissolution to water. Thereby, the self-dispersing pigment can be stably dispersed even if a pigment dispersing agent does not exist in the ink.

In the invention, a self-dispersing pigment means a pigment which satisfies the following requirements.

First, the pigment is dispersed in water such that the pigment density become 5% by mass based on water of 95% by mass, using dispersion apparatus such as an ultrasonic homogenizer, a nanomizer, a microfluidizer and a ball mill, without using a pigment dispersing agent. Next, a dispersion liquid in which the pigment is dispersed is put into a glass bottle, and is left for 8 hours. Herein, the self-dispersing pigment in the invention means that the pigment density of the supernatant fluid of the dispersing liquid after left 8 hours is 98% or more of the initial density.

At this time, a method for measuring the density of the pigment is not particularly limited, and a method for drying a sample to measure solids content, a method for diluting to suitable density to request from transmissivity may be used. The density of the pigment may be measured by the other method for requesting the density of the pigment correctly.

The "self-dispersing pigment" can be produced by subjecting the usual hydrophobic pigment to a surface modifying treatment such as an acid/base treatment, a coupling agent treatment, a polymer graft treatment, a plasma treatment, an oxidation/reduction treatment. Since the pigment (self-dispersing pigment) subjected to the surface treatment contains more water-soluble groups for demonstrating the solubility to water than the usual pigment, the pigment can be dispersed in the ink even if a pigment dispersing agent is not used.

Although the hydrophobic pigment to which the surface treatment is performed is not particularly limited, Specific examples thereof include the following pigments.

Examples of the black pigments include Raven 7000, Raven 5750, Raven 5250, Raven 5000 ULTRA II, Raven 3500, Raven 2000, Raven 1500, Raven 1250, Raven 1200, Raven 1190 ULTRA II, Raven 1170, Raven 1255, Raven 1080 and Raven 1060 (all of the black pigments described above are manufactured by Columbian Chemicals Company); Regal 400R, Regal 330R, Regal 660R, Mogul L, Black Pearls L, Monarch 700, Monarch 800, Monarch 880, Monarch 900, Monarch 1000, Monarch 1100, Monarch 1300 and Monarch 1400 (all of the black pigments described above are manufactured by Cabot Corporation); Color Black FW1, Color Black FW2, Color Black FW2V, Color Black 18, Color Black FW 200, Color Black S150, Color Black S160, Color Black S170, Pritex 35, Pritex U, Pritex V, Printex 140U, Printex 140V, Special Black 6, Special Black 5, Special Black 4A and Special Black 4 (all of the black pigments described above are manufactured by Deggusa Co.); No. 25, No. 33, No. 40, No. 47, No. 52, No. 900, No. 2300, MCF-88, MA 600, MA7, MA8 and MA100 (all of the black pigments described above are manufactured by Mitsubishi Chemical Co., Ltd.). However, examples of the black pigments are not limited thereto.

Specific examples of the cyan pigment include C.I. Pigment Blue-1, C.I. Pigment Blue-2, C.I. Pigment Blue-3, C.I.

Pigment Blue-15, C.I. Pigment Blue-15:1, C.I. Pigment Blue-15:2, C.I. Pigment Blue-15:3, C.I. Pigment Blue-15:4, C.I. Pigment Blue-15:34, C.I. Pigment Blue-16, C.I. Pigment Blue-22, and C.I. Pigment Blue-60. However, examples of the cyan pigment are not limited thereto.

Specific examples of the magenta pigment include C.I. Pigment Red 5, C.I. Pigment Red 7, C.I. Pigment Red 12, C.I. Pigment Red 48, C. I. Pigment Red 48: 1, C.I. Pigment Red 57, C.I. Pigment Red 112, C.I. Pigment Red 122, C.I. Pigment Red 123, C.I. Pigment Red 146, C.I. Pigment Red 168, C.I. Pigment Red 184, and C.I. Pigment Red 202. However, examples of the magenta pigment are not limited thereto.

Specific examples of the yellow pigment include C.I. Pigment Yellow-1, C.I. Pigment Yellow-2, C.I. Pigment Yellow-3, C.I. Pigment Yellow-12, C.I. Pigment Yellow-13, C.I. Pigment Yellow-14, C.I. Pigment Yellow-16, C.I. Pigment Yellow-17, C.I. Pigment Yellow-73, C.I. Pigment Yellow-74, C.I. Pigment Yellow-75, C.I. Pigment Yellow-83, C.I. Pigment Yellow-93, C.I. Pigment Yellow-95, C.I. Pigment Yellow-97, C.I. Pigment Yellow-98, C.I. Pigment yellow-114, C.I. Pigment yellow-128, C.I. Pigment Yellow-129, Pigment Yellow-138, C.I. Pigment Yellow-151, C.I. Pigment Yellow-154, and C.I. Pigment Yellow-180. However, examples of the yellow pigment are not limited thereto.

In the invention, magnetic substance particulates such as magnetite and ferrite, and titanium black or the like may be used.

As "the self-dispersing pigment", a commercial item can be used as it is besides pigment which performed surface modification processing to the above hydrophobic pigment. Examples of the commercially available pigments include cab-o-jet 200, cab-o-jet 250, cab-o-jet 260, cab-o-jet 270, cab-o-jet-300, IJX-444, JX-164, IJX-253, IJX-266 and IJX-273 (manufactured by Cabot Corporation); Microjet black CW-1 and Microjet black CW-2 (manufactured by Orient Chemical Industries, Ltd.), however, the invention will be not limited thereto.

Although water-soluble groups contained in "the self-dispersible pigment" may be any of groups having nonionic properties, cationic properties and anionic properties, particularly desirable are those of a sulfonic group, a carboxylic group, a hydroxyl group and a phophoric group. In the case of the sulphonic group, the carboxylic acid and the phosphoric acid, the acids may be used in a state of a free acid, however, these acids may form a salt. When the salt is formed, it is preferable that a counter ion of the acid is generally Li, Na, K, $NH_4$ or organic amine.

The content of the pigment contained in the ink preferably ranges from 0.1 to 15% by mass, more preferably in the range from 0.5 to 10% by mass, and still more preferably in the range from 1.0 to 8.0% by mass. When the content of the pigment is more than 10% by mass, clogging may be easily generated on the tip of a nozzle of a recording head. When the content of the pigment is less than 0.1% by mass, sufficient image density may not be obtained.

A refined material is preferably used for the pigment. For example, impurities can be removed by water washing, and adsorption methods such as an ultra-filtration-membrane method, an ion exchange treatment, activated carbon and zeolite. Although a refining process is not particularly limited, the density of the inorganic substance which originates in the impurities of the colorant in the ink is preferably 500 ppm or less, and more preferably 300 ppm or less.

When using a water-soluble colorant, i.e., dye, as the colorant, a known colorant or a colorant compounded newly can be used. Although any of water-soluble dye and dispersing dye are sufficient as the dye, of these, a direct dye or an acid dye can obtain bright color are preferable. Specific Examples include the following.

Examples of black dyes include C.I. Direct Black-2, -4, -9, -11, -17, -19, -22, -32, -80, -151, -154, -168, -171, -194, -195; C.I. Food Black-1, -2; C.I. Acid Black-1, -2, -7, -16, -24, -26, -28, -31, -48, -52, -63, -107, -112, -118, -119, -121, -156, -172, -194, -208.

Examples of blue dyes include C.I. Direct blue-1, -2, -6, -8, -22, -34, -70, -71, -76, -78, -86, -112, -142, -165, -199, -200, -201, -202, -203, -207, -218, -236, -287, -307; C.I. Acid blue-1, -7, -9, -15, -22, -23, -27, -29, -40, -43, -55, -59, -62, -78, -80, -81, -83, -90, -102, -104, -111, -185, -249, -254; C.I. Disperse Violet-33, C.I. Disperse Blue-14, -26, -56, -60, -73, -87, -128, -143, -154, -165, -165: 1, -176, -183, -185, -201, 214, -224, -257, -287, -354, -365, -368, C.I. Disperse Green-6: 1, -9.

Examples of red dyes include C.I. Direct red-1, -2, -4, -8, -9, -11, -13, -15, -20, -28, -31, -33, -37, -39, -51, -59, -62, -63, -73, -75, -80, -81, -83, -87, -90, -94, -95, -99, -101, -110, -189, -227; C.I. acid red-1, -4, -8, -13, -14, -15, -18, -21, -26, -35, -37, -52, -110, -144, -180, -249, -257, -289; C.I. Disperse Orange-13, -29, -31: 1, -33, -49, -54, -66, -73, -119, -163; C.I. Disperse Red-1, -4, -11, -17, -19, -54, -60, -72, -73, -86, -92, -93, -126, -127, -135, -145, -154, -164, -167: 1, -177, -181, -207, -239, -240, -258, -278, -283, -311, -343, -348, -356, -362.

Examples of yellow dyes include C.I. Direct-Yellow-1, -2, -4, -8, -11, -12, -26, -27, -28, -33, -34, -41, -44, -48, -58, -86, -87, -88, -132, -135, -142, -144, -173; C.I. Acid-Yellow-1, -3, -4, -7, -11, -12, -13, -14, -18, -19, -23, -25, -34, -38, -41, -42, -44, -53, -55, -61, -71, -76, -78, -79, -122; C.I. Disperse Yellow-3, -5, -7, -8, -42, -54, -64, -79, -82, -83, -93, -100, -119, -122, -126, -160, -184:1, -186, -198, -204, -224. These dyes may be used either alone or in combination of two or more kinds thereof.

Cationic dyes can be used besides a direct color or acid dye. Examples of the cationic dyes include C.I. basic yellow-1, -11, -13, -19, -25, -33, -36; C.I. basic red-1, -2, -9, -12, -13, -38, -39, -92; C.I. basic blue-1, -3, -5, -9, -19, -24, -25, -26, -28.

The content of the dye contained in the ink preferably ranges from 0.1 to 10% by mass, more preferably in the range from 0.5 to 8% by mass, and still more preferably in the range from 0.8 to 6% by mass. When the content of the dye is more than 10% by mass, clogging may be easily generated on the tip of a nozzle of a recording head in the ink-jet printing method. When the content of the dye is less than 0.1% by mass, sufficient image density may not be obtained.

A known organic solvent can be used for the water-soluble organic solvent. Examples of the water-soluble organic solvent polyalcohols such as ethylene glycol, diethylene glycol, propylene glycol, butylene glycol, triethylene glycol, 1,5-pentanediol, 1,2,6-hexanetriol, glycerin and the like; polyalcohol-ethers such as ethylene glycol monomethyl ether, ethylene glycol monoethyl ether, ethylene glycol monobutyl ether, diethylene glycol monomethyl ether, dieethylene glycol monoethyl ether, diethylene glycol monobutyl ether, propylene glycol monobutyl ether, dipropylene glycol monobuyl ether and the like; nitrogen containing solvents such as pyrrolidone, N-methyl-2-pyrrolidone, cyclohexylpyrrolidone, triethanol amine and the like; alcohols such as ethanol, isopropyl alcohol, butyl alcohol, benzyl alcohol and the like; sulfur containing solvents such as thiodiethanol, thidiglycerol, sulfolane, dimethylsulfoxide and the like; and propylene carbonate, ethylene carbonate.

The surfactant is added to the ink in order to adjust the surface tension of the ink. As a surfactant, nonionic surfactants and anionic surfactants which do not readily affect the dispersing state of the pigment are preferable.

As the nonionic surfactant, there may be used: polyoxyethylenenonyl phenyl ether, polyoxyethyleneoctyl phenyl ether, polyoxyethylenedodecyl phenyl ether, polyoxyethylenealkyl ether, polyoxyethylene fatty ester, sorbitan fatty ester, polyoxyethylenesorbitan fatty ester, fatty alkylolamide, acetylene alcohol ethyleneoxide adduct, polyethylene glycol polypropylene glycol block copolymer, polyoxyethylene ether of glycerin ester, polyoxyethylene ether of sorbitol ester and the like.

As the anionic surfactant, there may be used: an alkylbenzene sulfonate, an alkylphenyl sulfonate, an alkylnaphthalene sulfonate, a higher fatty acid salt, an alkyl sulfate of a higher fatty acid ester, a higher alkylsulfosuccinate and the like.

Ampholytic surfactants may be used, and as the ampholytic surfactant, there may be used: betain, sulfobetain, sulfate betain, imidazoline and the like. In addition to the above, there are exemplified: silicone type surfactants such as a polyoxyethylene adduct of polysiloxane; fluorine containing surfactants such as an oxyethyleneperfluoroalkyl ether and the like; biosurfactants such as Spiculisporic acid, rhamnolipid, lysolecithin and the like.

When adding a water-soluble polymer to the ink, it is necessary to select the polymer in consideration of affinity with the colorant, cohesiveness of the polymer substance itself or the like, on the basis of acid value or the like, and it is preferable to use an anionic polymer as the water-soluble polymer.

Particularly, when the acid value of the anionic polymer substance added to the ink for improving the image quality is 30 mgKOH/g or greater and less than 150 mgKOH/g, or the acid value is 150 mgKOH/g or greater, it is preferable that the degree of neutralization is 80% or less.

When the acid value of the anionic polymer substance is 30 mgKOH/g or greater and less than 150 mgKOH/g, the acid value is more preferably in a range of 50 to 120 mgKOH/g, and still more preferably 70 to 120 mgKOH/g. When the acid value is less than 30 mgKOH/g,jetting stability (when the ink is jetted from the recording head) may be reduced.

On the other hand, when the acid value of the anionic polymer is 150 mgKOH/g or greater, and the degree of neutralization is 80% or less, it is more preferable that the acid value is in a range of 200 to 400 mgKOH/g and the degree of neutralization is in a range of 50 to 80%. It is still more preferable that the acid value is in a range of 200 to 300 KOHmg/g and the degree of neutralization is in a range of 60 to 80%.

When the acid value is 200 mgKOH/g or greater and the degree of neutralization exceeds 80%, the viscosity of the ink may become large and the ink can not be normally injected.

As described above, as the anionic polymer, the amount of water-soluble groups of the anionic polymer added to the ink can be reduced by using the anionic polymer of the low acid value, or the anionic polymer of the high acid value in the degree of low neutralization. The viscosity rise of the ink can be suppressed and injection property can be secured.

Preferable examples of the anionic polymer selected by taking these properties into consideration include a high molecular compound containing a carboxyl group. This is because the anionic polymer is promptly insolubilized by the heterocyclic carboxylic acid component eluted from the surface of the recording paper when the ink is applied to the surface of the recording paper, since the degree of disassociation of the carboxyl group of the anionic polymer is small.

The high molecular compound containing the carboxyl group is preferably an anionic polymer having a hydrophilic part containing a hydrophilic group and a hydrophobic part, and the hydrophilic group contains the carboxyl group Although preferable examples of the anionic polymers are shown, the invention is not limited thereof.

Examples of the anionic polymers include alginic acid salt, acrylic acid salt, carboxymethylcellulose sodium or the like. Of those, a copolymer obtained from a monomer having an alpha, beta-ethylene unsaturated group constituting a hydrophilic part and a monomer having an alpha, beta-ethylene unsaturated group constituting a hydrophobic part is preferable.

It is more preferable that the monomer constituting the hydrophilic part is at least one kind selected from the group consisting of acrylic acid, methacrylic acid maleic anhydride and maleic acid, and the monomer constituting the hydrophobic part is at least one kind selected from the group consisting of alkyl of styrene acrylic acid ,alkyl of styrene methacrylic acid, arylester and alkylarylester.

The molecular weight of the water-soluble polymer such as the anionic polymer is preferably in a range of 3000 to 15000 in the weight average molecular weight due to Gel Permeation Chromatography (GPC) method, more preferably in a range of 4000 to 10000, and still more preferably in a range of 4000 to 7000.

As the monomer having an alpha, beta-ethylenically unsaturated group constituting the hydrophilic part, there is not any specific limitation. As examples of the monomer, there may be used: monomers having a carboxyl group. Specific examples thereof include acrylic acid, methacrylic acid, crotonic acid, itaconic acid, itaconic acid monoester, maleic acid, maleic acid monoester, fumaric acid, fumaric acid monoester. Of these, particularly, acrylic acid, methacrylic acid, maleic acid and anhydrous maleic are preferred, and these may be used singly or in combination of two or more kinds thereof.

As the monomer having an alpha, beta-ethylenically unsaturated group constituting the hydrophobic part there is not any specific limitation. As examples of the monomer, there may be used: styrene, styrene derivatives such as alpha-methylstyrene and vinyltoluene and the like; vinylnaphthalene, vinylnaphthalene devrivative, acrylic acid alkyl ester, methacrylic acid alkyl ester, crotonic acid alkyl ester, itaconic acid dialkyl ester, maleic acid dialkyl ester and the like. Particularly, styrene, methacrylic acid alkyl ester, acrylic acid alkyl, aryl and alkyl aryl ester are preferred. These may be used singly or in combination of two or more kinds thereof.

The water-soluble polymer described above may be used singly or in combination of two or more kinds thereof. Although the addition amount thereof cannot simply be specified since the amount differs greatly depending on the colorant used, the amount is generally in in a range of 0.1 to 100% by mass, preferably in in a range of 1 to 70% by mass, and more preferably in in a range of 3 to 50% by mass relative to the weight of the colorant.

For the ink used for the invention, it is also useful to add methyl cellulose, ethyl cellulose and derivatives thereof, glycerins, poly glycerin and polyethylene oxide thereof, a polypropylene oxide adduct, or a polysaccharide, and derivatives thereof as a viscosity adjuster. Specific examples of the viscosity adjusters include glucose, fructose, Mannit, D-sorbitol, dextran, xanesangum, curdlan, cycloamylose, maltitol and derivatives thereof.

The viscosity of the ink used for the ink-jet printing method of the invention is preferably in the range from 1.5 to 5.0 mPa.s, and more preferably in the range from 1.5 to 4.0 mPa.s. For measuring the viscosity of the ink, a rotating viscosity meter Leo Matt 115 (manufactured by Contraves) is used, and the viscosity of the ink is measured at 23° C. and at a shear speed of $1400s^{-1}$.

The pH of the ink may be adjusted to the desired value, and examples of substances for adjusting pH include potassium hydrate, sodium hydrate, lithium hydroxide, ammonium hydroxide, triethanolamine, diethanolamine, ethanol amine, 2-amino-2-methy-1-propanol, ammonia, ammonium phosphate, potassium phosphate, sodium phosphate, lithium phosphate, sodium sulfate, acetic acid salt, lactic acid salt, benzoic acid salt, acetic acid, hydrochloric acid, nitric acid, sulfuric acid, phosphoric acid, propionic acid, and P-toluenesulfonic acid. Or, common pH buffer, for example, good buffers may be used. The pH of the ink is preferably in a range of 3 to 11, and particularly preferably 4.5 to 9.5.

It is preferable that the surface tension of the ink is in a range of 20 to 40 mN/m. If the surface tension is less than 20 mN/m, the ink penetration to the recording paper is too fast, and since ink permeates to the inside of the recording paper, the reduction of the image density and the bleeding of characters may be generated. Since the ink penetration to the recording paper becomes retarded and drying characteristics get worse when the surface tension is larger than 40 mN/m. Thereby it may be difficult to use with high-speed printing.

The surface tension of the ink is more preferably in a range of 25 to 37 mN/m, and is still more preferably in a range of 28 to 35 mN/m. The surface tension of the ink is measured at 23° C. under 50% RH using a Wilhelmy type surface tensiometer.

Examples of methods for adjusting the surface tension of the ink include a method for adding at least one kind selected from the group consisting of the surfactant, polyhydric alcohols and monohydric alcohols to the ink. When adding the surfactant to the ink, at least one kind of a nonionic surfactant and an anionic surfactant is preferably used.

The sum of the content of the compound in the ink, it is preferably in a range of 0.01 to 3.0% by mass, more preferably 0.03 to 2.0% by mass, and still more preferably 0.05 to 1.5% by mass. Particularly, when the surfactant is independently used, it is preferable that the content is in a range of 0.3 to 1.5% by mass.

When monohydric alcohols including an ether bond are used, at least one kind of compound selected from the following general formula (1) is used. The sum of the content of the compound represented by the general formula (1) in the ink is preferably in a range of 1 to 5% by mass, more preferably 2 to 10% by mass and still more preferably 3 to 8% by mass.

$$CnH_{2n+1}(CH_2CRHO)_mH \qquad \text{Formula (1)}$$

wherein, in Formula (1), n represents the integer of 1 to 6, m represents the integer of 1 to 3, and R represents a hydrogen atom or represents an alkyl group having the number of carbon atoms of 1 to 5.

When the monohydric alcohols except being represented by the general formula (1) are contained, ethanol, propanol and butanol or the like are preferably used. The sum of the content in the ink is preferably is in a range of 1.0 to 8.0% by mass, and more preferable 2.0 to 5.0% by mass. The surfactant, polyhydric alcohols and monohydric alcohol described above may be simultaneously contained.

When the pigment is used for the ink in the ink-jet record method of the invention, for example, the ink described above can be obtained by adding a pigment of a prescribed amount to a water solution, sufficiently stirring the resultant mixture, dispersing the resultant mixture using a disperser, excluding coarse particles by centrifugal separation or the like, adding and mixing a prescribed solvent and additive or the like to the resultant mixture while stirring, and filtering the resultant mixture.

In this case, the concentrated dispersing element of the pigment is previously produced, and a method for diluting at the time of ink manufacture can also be used. The grinding step of the pigment may be provided before the dispersing step. Or, after mixing a prescribed water-soluble organic solvent, water and a pigment dispersing agent, the pigment may be added, and the resultant mixture may be dispersed using the disperser.

Commercially available dispersing machines may be used. There are exemplified: a colloid mill, a flow jet mill, a slasher mill, a high speed disperser, a ball mill, an attriter, a sand mill, a sand grinder, an ultrafine mill, an eiger motor mill, a dyno mill, a pearl mill, an agitator mill, a cobol mill, a three-roll mill, a two-roll mill, an extruder, a kneader, a micro-fluidizer, a laboratory homgenizer, an ultrasonic homogenizer and the like, which may be used singly or in combination thereof. It is preferable to employ a dispersing method without using a dispersing medium in order to prevent contamination of inorganic impurities, preferably employing a micro-fluidizer, an ultrasonic homogenizer and the like. In the Examples of the invention to be described later, dispersing operation is performed using an ultrasonic homogenizer, a micro-fluidizer or the like.

On the other hand, For instance, the ink which uses a self-dispersing pigment as the colorant pigment can be obtained by treating the surface reforming to a pigment, adding the pigment obtained to water, stirring sufficiently the pigment, dispersing by a disperser same as the disperser if necessary, excluding coarse particles by centrifugal separation or the like, adding a prescribed solvent and additive or the like, and stirring, mixing and filtering.

When the recording paper of the invention is printed by the ink-jet printing method using ink described above, the ink drop amount ejected from a nozzle of recording head is preferable in a range of 1 to 20 pl, and still more preferably 3 to 18 pl.

When the ink drop amount is in a range of 1 to 20 pl, and preferably 3 to 18 pl in a printing due to a so called thermal ink-jet printing method which makes thermal energy act, forms ink droplets and prints, it is preferable that the dispersing particle diameter of the pigment in the ink using the pigment is in a range of 20 to 120 nm of the volume mean particle size, and the number of coarse particles of whose the volume average particle diameter (dispersing particle diameter) is 500 nm or more is $5\times10^5$ or less pieces in the ink of 2 μl. If the volume mean particle size (dispersing particle diameter) is smaller than 20 nm, sufficient image density may not be obtained. If the volume mean particle size (dispersing particle diameter) is larger than 120 nm, clogging at a recording head is likely to occur, and the stable jetting performance may be unable to be secured. When the number of coarse particles of which the volume average particle diameter (dispersing particle diameter) is 500 nm or more is more than $5\times10^5$ pieces in the ink of 2 μl, the clogging at the recording head is likely to occur, and the stable jetting performance may be unable to be secured. The number of coarse particles is more preferably $3\times10^5$ or less pieces in the ink of 2 μl, and still more preferably $2\times10^5$ or less pieces.

It is preferable that the storage elastic modulus of the ink at 24° C. is in a range of $5\times10^{-4}$ to $1\times10^{-2}$ Pa. Since the ink has suitable elasticity in the range, the behavior of the ink applied to the surface of the recording paper is preferable. The storage elastic modulus of the ink is a value when measured in the low shear speed range in a range of angular velocity of 1 to 10 rad/s. The value can be easily measured, if the apparatus which can measure the viscoelasticity of the low shear speed range is used. Examples of the measurement apparatus include VE type viscoelasticity analyzer (manufactured by a VILASTIC SCIENTIFIC INC. company), and DCR viscoelasticity measuring apparatus for low viscosity (manufactured by Paar Physica).

If a known ink-jet machine uses an ink-jet printing method, the ink-jet printing method in the invention can provide good printing quality. The ink-jet printing method of the invention can be applied to an inkjet printing machine which has a function heating the recording paper and the ink at the temperature of 50° C. to 200° C. and promoting the absorption and fixing of the ink, and is equipped with a heating unit for heating the recording paper or the like during printing or before and after printing.

Next, an example of an ink-jet printing machine suitable for conducting the ink-jet record method in the invention will be described. The example is a so called multi-pass type, and the recording head scans on the recording paper two or more times to form an image.

A method for ejecting the ink from a nozzle is a so called thermal ink-jet printing method for foaming the ink in the nozzle by carrying out energization heating to a heater provided in the nozzle, and ejecting the ink with the pressure. In another method, a pressure-sensitive element is deformed physically by energizing to the pressure-sensitive element, and the ink is ejected from the nozzle using the power caused by the deformation. This method using a piezoelectric element for a pressure-sensitive element is typical. In the ink-jet printing machine used in the ink-jet record method of the invention, the method for ejecting the ink from the nozzle may be said which method is not limited to these methods. These aspects are the same as the following.

Nozzles are arranged in the orthogonal direction with the main scanning direction of a head carriage. Specifically, the nozzles can be arranged in one row at a density of 800 per inch. The number and density of the nozzles are arbitrary. Not only can the nozzles can be arranged in one single row, but the nozzles can also be arranged in a staggered formation.

Ink tanks storing the ink used for the invention for each color of cyanogen, magenta, yellow and black are integrally attached to recording heads on the upper part of the recording head. The inks stored in the ink tanks are supplied to the recording head corresponding to the colors. The ink tank and the recording head may be integrally formed. However, the invention is not limited to this method, and for example, the ink tank may be separately arranged from the recording head, and the ink may be supplied to the recording head from the ink tank through an ink supply tube.

A signal cable is connected to each of these recording heads. This signal cable transmits the image information after treated by an image processing part to each recording head for each color of cyanogen, magenta, yellow and black.

The recording head is fixed to the head carriage. The head carriage is freely slidably attached in the main scanning direction along with a guide rod and a carriage guide. The head carriage can be reciprocatingly driven along the main scanning direction through a timing belt by rotating a driving motor to predetermined timing.

A platen is fixed to the lower part of the head carriage, and the recording paper used for the invention is conveyed on the platen at a predetermined timing by a conveyance roller for sending paper. For example, the platen comprises a plastic molding material or the like.

Thus, the recording paper of the invention can be printed by using the ink to be described. The example of the multi-pass method provided with five recording heads has been described. However, when applying the ink-jet printing method of the invention to the ink-jet printing machine of a multi-pass method, it is not limited to this example. For example, the ink-jet printing machine may have two recording heads of a black head and a color head. Among these, in the color head, the nozzle may be divided in the row direction, and a predetermined color may be assigned to each range divided.

When a high-speed printing of 10 ppm or more (10 sheet/minute or more) which is equal to a laser printer used in office is performed, the scanning rate of the recording head is 25 or more cm/second. However, in the high-speed scan of the recording head, the interval by which the ink of two different colors is printed becomes narrow, and the inter-color bleeding (ICB) is easily generated. In order to enhance the ink drying, it is necessary to use ink having low surface tension. The use of the ink having low surface tension causes the generation of feathering and the reduction of image density. Since the ink having low surface tension has the high penetration to a recording paper, the printed character and image are transparent from the back, and can be easily seen. Thereby, the both side printability is ruined.

However, when the high-speed printing is performed using a conventional recording paper, the generation of the feathering and the reduction of the image density are caused. Since ink having low surface tension has high penetration to a recording paper, the printed character and image are transparent from the back, and can be easily seen through. Thereby, the double-sided printability is ruined. However, if the recording paper of the invention is used, the generation of the problem can be prevented.

The scanning rate of the recording head means the movement speed of the recording head when the recording head prints by scanning on the recording paper two or more times in a so called multi-pass method in which the recording head runs perpendicularly to the ejected direction of the recording paper.

Next, the second example of an ink-jet printing machine suitable for conducting the ink-jet record method in the invention will be described. The example is called one path method. In the one path method, a recording head has a width almost equal to that of the recording paper, and when the recording paper passes the lower part of the recording head, printing is concluded. Since high productivity is acquired compared with the multi-pass method, the high-speed printing more than that of a laser recording method can be performed.

Since the one path method does not need to scan the recording head two or more times like a multi-pass method, high-speed printing can be easily performed at the recording paper conveying speed of the 60 mm/second or more (speed at which the recording paper passes the lower part of the recording head) corresponding to 10 ppm or more. On the other hand, since division printing cannot be performed, it is necessary to eject a lot of ink from the recording head at once. Therefore, in a conventional ink-jet printing method not using the recording paper of the invention, feathering and inter-color bleeding occur and the reduction of image density, the reduction of the double-sided printability, the inferior dryability are caused.

However, even when high-speed printing in which the scanning rate of the recording head is 250 mm/second or more in a multi-pass method, or high-speed printing is performed at the recording paper conveying speed of 60 mm/second or more in the state in which the recording head is fixed in the one path method in the inkjet printing method of the invention, a high definition image without generating feathering and inter-color bleeding can be obtained, and the the dryness can be enhanced without ruining both side printability.

This can be understood because of the following reason. The cationic substance and heterocyclic carboxylic acid treated on the recording paper surface are eluted into ink at the time of coming into contact with the recording paper of the invention, and ink, and the eluted heterocyclic carboxylic acid insolubilizes the colorant and the hydrophilic group of the anionic polymer contained if necessary in the ink. The eluted cationic substance insolubilizes the dye, and the anionic polymer contained in the pigment and/or the ink is collodized to be agglutinated and settled.

The scanning rate of the recording head is preferably 500 mm/second or more from a viewpoint of "the productivity which is equal to a laser printer", and more preferably 1000 mm/second or more. The conveying speed of the recording paper is preferably 100 mm/second or more, and more preferably 210 mm/second or more.

In any of these methods, in order to apply ink sufficient at the time of high-speed printing to form a solid image to a recording paper, the maximum quantity of ink to be ejected is 6 ml/m$^2$ or more. However, if the ink-jet printing method of the invention is used in high-speed printing carried out in the maximum quantity of ink, an image not having feathering and inter-color bleeding can be obtained, and both side printing can be performed in the same manner as in a laser printer.

The maximum quantity of ink to be ejected is preferably is in a range of 7 to 20 ml/m$^2$, more preferably 10 to 18 ml/m$^2$.

As described above, according to the ink-jet printing method of the invention, in the ink-jet printing machine performing a high-speed printing of 10 ppm or more, the printing which provides sufficient image density can be performed without occurring poor images such as inter-color bleeding and feathering.

<Method for Electrophotographically Recording an Image>

A method for electrophotographically recording an image of the invention, including: uniformly charging a surface of an electrostatic latent image support; exposing the surface of the electrostatic latent image support to light, to thereby form an electrostatic latent image; developing the electrostatic latent image formed on the surface of the electrostatic latent image support, using an electrostatic image developer, to form a toner image; transferring the toner image onto a surface of a recording paper; and fixing the toner image transferred onto the surface of the recording paper.

Herein, as the recording paper, the recording paper of the invention described above is used, and the toner image is transferred and fixed onto the surface containing the heterocyclic carboxylic acid, the water-soluble polymer and the cationic substance of the recording paper.

If the method for recording the image of the electrophotographic printing method of the invention is used, high-definition images are obtained in the same manner as in the conventional method.

The image forming machine used for the method for recording image of the electrophotographic printing method of the invention is not particularly limited as long as the electrophotographic printing method uses charging, exposing, developing, transferring and fixing. For instance, a color image formation machine of a development system of four cycles forming the toner image by sequentially applying the development agent containing each color toner to a photo conductor (an electrostatic latent image support), and a color image formation machine (so-called tandem machine) which is provided with four development units corresponding to each color or the like can be used when four color toners of cyan, magenta, yellow and black are used.

The toner used when forming the image is not particularly limited and any known toner can be used. For instance, in order to be able to obtain highly accurate images, a toner which is spheroidal and has a small size distribution can be used. Toners including a binding resins having a low melting point, which can be fixed at low temperatures, can be used in view of saving energy.

EXAMPLES

The present invention will be more specifically explained with reference to the following examples, though it should be understood that the invention is not restricted to these examples.

First, recording papers for use in the Examples and Comparative Examples described later are produced as described below.

-Preparation of Recording Paper-

<Recording Paper 1>

Hard wood kraft pulp is bleached by an Elemental Chlorine Free (ECF) multi-stage bleaching process including an oxygen-bleaching step, an alkali-extracting step, and a treating step by vapor-phase chlorine dioxide. The pulp thus obtained is beaten to a freeness of 450 ml. A base paper is made using 100 parts by mass of the bleached and beaten pulp, 3 parts by mass of bentonite filler, 3 parts by mass of calcium carbonate light filler, and 0.1 parts by mass of alkyl ketene dimer (AKD) internal sizing agent.

The base paper thus obtained is size pressed using as a surface sizing agent a coating solution prepared by blending 93 parts by mass of water, 6 parts by mass of thiocyanic acid calcium tetrahydrate, 2 parts by mass of coumarinic acid, 3 parts by mass of oxidized starch (Ace A manufactured by Oji Cornstarch Co., Ltd.), 1 part by mass of sodium sulfate as the electronically conductive agent. In this way, a recording paper 1 is obtained with a coating of calcium thiocyanate (coated amount 10 g/m$^2$ (coated amount, here and as used below, has the same meaning as treatment amount described above)), coumarinic acid (coated amount: 0.5 g/m$^2$) and oxidized starch (coated amount: 0.7 g/m$^2$) on the surface of the paper.

For reference, when the recording paper 1 is used only for ink-jet printing, the electronically conductive agent coating is not required. This also applies to when producing the following examples of the recording paper.

<Recording Paper 2>

Hardwood kraft pulp is bleached by a Total Chlorine Free (TCF) multistage bleaching process including a xylanase-treatment step, an alkali-extracting step, a hydrogen peroxide-treating step, and an ozone-treating step. The pulp thus obtained is beaten to a freeness of 450 ml. A base paper is made using 100 parts by mass of the bleached and beaten pulp, 3 parts by mass of kaolin filler, 6 parts by mass of calcium carbonate light filler, and 0.2 parts by mass of alkenyl succinic anhydride (ASA) internal sizing agent.

The base paper thus obtained is size pressed using as a surface sizing agent a coating solution prepared by blending 97 parts by mass of water, 1 part by mass of polyacrylic acid, 1 part by mass of dimethyldiallylammonium chloride, 1 part by mass of pyrrolidone carboxylic acid. In this way, a recording paper 2 is obtained with a coating of polyacrylic acid (coated amount: 0.5 g/m$^2$), poly (dimethyldiallylammonium chloride) (coated amount: 0.5 g/m$^2$) and pyrrolidone carboxylic acid (coated amount: 0.5 g/m$^2$) on the surface of the paper.

The poly (diallyldimethyl ammonium chloride) used for coating is a cationic organic molecule represented by the following structural formula, and a commercial product can be used (trade name: PAS-H-5L, manufactured by Nittobo, weight average molecular weight Mw=40000).

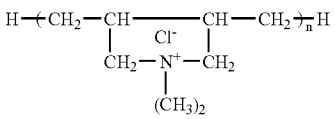

<Recording Paper 3>

Soft wood mechanical pulp is bleached by hydrosulfite and is beaten to a freeness of 450 ml. A base paper is made using 100 parts by mass of the bleached and beaten pulp, 8 parts by mass of calcium carbonate light filler and 0.02 parts by mass of alkenyl succinic anhydride (ASA) internal sizing agent.

The base paper thus obtained is size pressed using as a surface sizing agent a coating solution prepared by blending 96 parts by mass of water, 1 part by mass of cation-modified polyvinyl alcohol (trade name: Gohsefimer, manufactured by Nippon Synthetic Chemical Industry Co., Ltd), 2 part by mass of magnesium nitrate and 1 part by mass of pyrrole carboxylic acid. In this way, a recording paper 3 is obtained by with a coating of pyrrole carboxylic acid (coated amount: 0.5 g/m$^2$), magnesium nitrate (coated amount: 1.0 g/m$^2$) and cation-modified polyvinyl alcohol (coated amount: 0.5 g/m$^2$) on the surface of the paper.

<Recording Paper 4>

Hard wood kraft pulp is bleached by a TCF process as in the recording paper 2 and is beaten. A base paper is made using 100 parts by mass of the bleached and beaten pulp, 3 parts by mass of calcium carbonate light filler, 3 parts by mass of saponite filler, and 2 parts by mass of neutral rosin sizing agent.

The base paper thus obtained is size pressed using as a surface sizing agent a coating solution prepared by blending 34 parts by mass of water, 5 parts by mass of an oxidized starch (Ace A manufactured by Oji Cornstarch Co., Ltd.) as the surface sizing agent, 60 parts by mass of 0.1 N acetic acid and 1 part by mass of calcium thiocyanate. In this way, a recording paper 4 is obtained with a coating of oxidized starch (coated amount: 1.0 g/m$^2$), acetic acid (coated amount: 0.1 g/m$^2$) and calcium thiocyanate (coated amount: 0.5 g/m$^2$) on the surface of the paper.

<Recording Paper 5>

Hard wood sulfite pulp is bleached by an ECF process as in the recording paper 2 and is beaten. A base paper is made using 100 parts by mass of the bleached and beaten pulp, 15 parts by mass of calcium carbonate light filler and 0.1 parts by mass of an alkenyl succinic anhydride (ASA) internal sizing agent.

The base paper thus obtained is size pressed using as a surface sizing agent a coating solution prepared by blending 80 parts by mass of water, 5 parts by mass of oxidized starch (Ace B manufactured by Oji Cornstarch Co., Ltd.) and 10 parts by mass of furancarboxylic acid. In this way, a recording paper 5 is obtained with a coating of furancarboxylic acid (coated amount: 2.0 g/m$^2$) and oxidized starch (coated amount: 0.8 g/m$^2$) on the surface of the paper.

<Recording Paper 6>

Soft wood sulfite pulp is bleached by an ECF process as in the recording paper 2 and is beaten. A base paper is made using 100 parts by mass of the bleached and beaten pulp, 20 parts by mass of kaolin filler and 0.05 parts by mass of alkyl ketene dimer (AKD) internal sizing agent.

The base paper thus obtained is size pressed using as a surface sizing agent a coating solution prepared by blending 92 parts by mass of water, 5 parts by mass of oxidized starch (Ace A manufactured by Oji Cornstarch Co., Ltd.) and 1 part by mass of calcium thiocyanate. In this way, a recording paper 6 is obtained with a coating of thiocyanic acid calcium (coated amount: 1.0 g/m$^2$) and oxidized starch (coated amount: 2.0 g/m$^2$) on the surface of the paper.

<Recording Paper 7>

Hard wood sulfite pulp is bleached by an ECF process as in the recording paper 2 and is beaten. A base paper is made using 100 parts by mass of bleached and beaten pulp, 20 parts by mass of kaolin filler and 0.05 parts by mass of alkyl ketene dimer (AKD) internal sizing agent.

The base paper thus obtained is size pressed using as a surface sizing agent a coating solution prepared by blending 95 parts by mass of water, 1 part by mass of pyridine pentacarboxylic acid as the surface sizing agent and 4 part by mass of calcium formate. In this way, a recording paper 7 is obtained with a coating of pyridine pentacarboxylic acid (coated amount: 0.5 g/m$^2$) and calcium formate (coated amount: 2.0 g/m$^2$) on the surface of the paper.

-Measurement of Recording Paper Properties-

The properties of the recording paper obtained are measured under the following conditions.

The Stockigt sizing degree is measured in accordance with JIS-P-8122:1976 in a standard environment (23° C. and 50% relative humidity). The surface and volume electric resistivity are measured in a standard environment in accordance with JIS-K-6911.

The smoothness is measured in accordance with JIS-P-8119:1998 using an Oken type digital display type air permeability measuring smoothness instrumet EY type (manufactured by Asahi Seiko Co., Ltd.). The formation index is measured using a 3D Sheet Analyzer (M/K950) manufactured by M/K Systems, Inc. (MKS Corp.), in which the aperture of the analyzer is set to a diameter of 1.5 mm, and using a micro formation tester (MFT).

The measurement results of the above properties values are shown in Table 1 with the composition component of the treatment solution used for production of the recording paper.

[Table 1]

-Preparation of Ink-

The inks, used in the Examples and Comparative Examples to be described, are produced as described below.

<Ink 1>

As a water-soluble polymer (a dispersant for dispersing a pigment), a solution (solids content 10 percent by mass) is prepared of the sodium salt of a styrene-methacrylic acid copolymer (monomer ratio: 50/50, weight average molecular weight: 7000, acid value 200 mg KOH/g, neutralization degree 20%). To 45 parts by mass of this solution is added 210 parts by mass of ion-exchanged water. Then, whilst agitating, 45 parts by mass of carbon black (trade name: BPL, manufactured by Cabot Corporation) is added and further agitated for 30 minutes. The solution is then dispersed at 10000 psi/30 path using a microfluidizer.

The pH of the solution resulting from dispersion treatment is adjusted to pH 9 by a NaOH aqueous solution of 1 mol/l. After pH adjustment centrifugal separation is carried out using a centrifuge (8000 rpm, 15 minutes), the solution is then filtered through a pore size 2 μm membrane filter, and is diluted with pure water to obtain a pigment dispersion 1 having a solids content of 10% by mass.

Ethylene glycol 12 parts by mass
Ethanol: 4 parts by mass
Urea: 5 parts by mass
Sodium lauryl sulfate: 0.1 parts by mass Next, a mixture with the composition listed above is made up by adding deionized water to make up a total of 50 parts by mass. It is agitated for 30 minutes, 50 parts by mass of the pigment dispersion 1 is added, then stirred for a further 30 minutes. The obtained solution is then filtered through a pore size 2 μm membrane filter, thereby preparing the ink 1.

The surface tension of the ink 1 is 35 mN/m, the viscosity thereof is 2.6 mPa.s, and the elastic modulus thereof is $1.0\times10^{-3}$ Pa at 24° C. The number of coarse particles having a particle diameter of 500 nm or more in the ink 1 is $11.2\times10^{4}$ particles.

<Ink 2>

Dye (C.I. Direct Yellow -1, 10% solution): 20 parts by mass
Ethylene glycol: 25 parts by mass
Water-soluble polymer (styrene maleic acid/sodium methacrylate copolymer (monomer ratio—20/80, weight average molecular weight—6000, acid value—100 mgKOH/g, neutralization degree—90%)): 1.5 parts by mass
Urea: 5 parts by mass
Surfactant (Surfynol 465): 2 parts by mass Deionized water is added to the above composition to make a total amount of 100 parts by mass, then stirred for 30 minutes. Thereafter, the resultant mixture is filtered through a pore size 1 μm membrane filter, and thereby preparing an ink 2. The surface tension of the ink 2 is 31 mN/m, the viscosity thereof is 2.0 mPa.s, and the elastic modulus thereof is $1.0\times10^{-2}$ Pa at 24° C.

<Ink 3>

Pigment (C.I. Pigment Blue 15: 3): 4 parts by mass
Water-soluble polymer (Styrene acrylic acid/potassium acrylate copolymer (monomer ratio—33/67, weight average molecular weight—6100, acid value—50 mgKOH/g, neutralization degree—95%)): 1.5 parts by mass
Diglycerin ethylene oxide adduct: 5 parts by mass
Sulfolane: 5 parts by mass
Surfactant (Nonion E-215, manufactured by Nippon Oil & Fats Co., Ltd.): 0.03 parts by mass Deionized water is added to the mixture having the above composition to make a total amount of 100 parts by mass, then stirred for 30 minutes. Thereafter, the resultant mixture is filtered through a pore size 2 μm membrane filter, and thereby preparing the ink 3. The surface tension of the ink 3 is 30 mN/m, the viscosity thereof is 2.8 mPa.s, and the elastic modulus thereof is $2.5\times10^{-3}$ Pa at 24° C. The number of coarse particles having a particle diameter of 500 nm or more in the ink 3 is $0.08\times10^{4}$ particles.

<Ink 4>

Pigment (C.I. Pigment Red 122): 4 parts by mass
Diethylene glycol: 10 parts by mass
Propylene glycol: 5 parts by mass
Thiodiethanol: 5 parts by mass
Surfactant (trade name: Surfynol 465 manufactured by Nisshin Chemicals Co., Ltd.): 0.03 parts by mass Deionized water is added to the mixture having the above composition to make a total amount of 100 parts by mass, then stirred for 30 minutes. Thereafter, the resultant mixture is filtered through a pore size 2 μm membrane filter, and thereby preparing the ink 4. The surface tension of the ink 4 is 28 mN/m, the viscosity thereof is 2.8 mPa.s, and the elastic modulus thereof is $1.0\times10^{-2}$ Pa at 24° C. The number of coarse particles having a particle diameter of 500 nm or more in the ink 4 is $0.03\times10^{4}$ particles.

<Ink 5>

Surface-treated pigment (C.I. Pigment Yellow 17): 4 parts by mass
Water-soluble polymer (styrene maleic acid/sodium methacrylate copolymer (monomer ratio—20/80, weight average molecular weight—6000, acid value—250 mgKOH/g, neutralization degree 95%)): 1.5 parts by mass
Glycerin: 15 parts by mass
Triethylene glycol monobutyl ether: 5 parts by mass
Surfactant (trade name: Surfynol TG manufactured by Nisshin Chemicals Co., Ltd.): 0.03 parts by mass Deionized water is added to the mixture having the above composition to make a total amount of 100 parts by mass, then stirred for 30 minutes. Thereafter, the resultant mixture is filtered through a pore size 2 μm membrane filter, thereby preparing the ink 5. The surface tension of the ink 5 is 29 mN/m, the viscosity thereof is 2.9 mPa.s, and the elastic modulus thereof is $1.0\times10^{-2}$ Pa at 24° C. The number of coarse particles having a particle diameter of 500 nm or more in the ink 4 is $0.03\times10^{4}$ particles.

<Ink 6>

Dye (Direct Red 227, 10% solution): 20 parts by mass
Ethylene glycol: 25 parts by mass
Water-soluble polymer (styrene maleic acid/sodium methacrylate copolymer (monomer ratio—20/80, weight average molecular weight—6000, acid value—35 mgKOH/g, neutralization degree 95%)): 1.5 parts by mass
Urea: 5 parts by mass
Surfactant (trade name: Surfynol 465 manufactured by Nisshin Chemicals Co., Ltd.): 2 parts by mass Deionized water is added to the mixture having the above composition to make a total amount of 100 parts by mass, then stirred for 30 minutes. Thereafter, the resultant mixture is filtered through a pore size 1 μm membrane filter, thereby preparing the ink 6. The surface tension of the ink 6 is 31 mN/m, the viscosity thereof is 2.0 mPa.s, and the storage elastic modulus thereof is $1.0\times10^{-2}$ Pa at 24° C.

-Measurement of Ink Properties-

The properties of the obtained ink are measured under the following conditions.

The surface tension is measured at 23° C. under 50% RH using a Wilhelmy type surface tensiometer.

For measurement of the viscosity, the ink is put in a measurement container, and the measurement container is attached to a neo mat 115 (manufactured by Contraves). And the viscosity of the ink is measured under the conditions of a temperature of 23° C. and shear rate of $1400s^{-1}$ The elastic modulus is measured at 24° C. using a VE type viscoelasticity analyzer (manufactured by Vilastic Scientific, Inc.).

In this case, measurement is performed such that the angular velocity becomes within the range 1 to 10 rad/s, and the elastic modulus is obtained. The value at 10 rad/s is shown.

The values of these properties are shown in Table 2 together with the type, acid value and degree of neutralization of the anionic polymers and the colorant used for production of the inks.

[Table 2]

Examples 1 to 3 and Comparative Examples 1 to 6

The recording paper and ink obtained are used in the combinations as shown in Table 3, the printing test is performed by the ink-jet printing machine and the electronic photograph recorder which will be described later, and various evaluations are performed. The result is shown in Table 3.

The number shown in the column of "Paper No." in Table 3 means the recording paper used in each Example/Comparative Example (for example, the recording paper 1 in Example 1), and the number which is shown in the column of "Ink No." means the ink used in each Example/Comparative Example. In Comparative Example 6, a commercially available plain paper for ink-jet (jet laser (manufactured by Mitsubishi Paper Mills, Ltd.)) is used as a recording paper.

As the thermal ink-jet printing machine for the printing tests, a Work Centre B900 (manufactured by Fuji Xerox) is used. The printing test is performed in an environment of 23° C. and 55% relative humidity (RH) by filling up the ink tank with each ink shown in Table 3. Recording heads have 256 nozzles at a nozzle pitch of 800 dpi. The recording paper is printed at a dropping amount of about 15 pl; the maximum quantity of ink/pretreatment liquid ejected about 15 $ml/m^2$; the printing mode—one side batch printing; and scanning rate of the recording head of about 1100 mm/second. Hereinafter, various evaluations will be described.

-Image Optical Density-

The image optical density of a solid patch part after one day from printing is measured using a X-Rite369 (manufactured by X-Rite). The criteria for evaluation are as follows, and "A" and "B" indicates acceptable levels.

A: 1.5 or more
B: no less than 1.0 and less than 1.5
C: less than 1.0

-Inter-Color Bleeding (ICB) Evaluation-

The inks of two colors are printed as 2 cm by 2 cm square patches so as to come into contact with each other.

The inter-color bleeding is evaluated by visually inspecting the color mixing at the part where the colors patches contact, according to the following criteria. "A" and "B" indicate acceptable levels.

A: no color mixing
B: slight color mixing, but not enough to present problems
C: color mixing enough to present problems -Feathering Evaluation- 8-point font sized characters are printed with inks containing dye and inks containing pigments. The feathering evaluation is visually performed according to the following criteria. "A" and "B" indicate acceptable levels.

A: no bleeding observed in kanji and hiragana characters
B: bleeding observed in only very limited parts of kanji and hiragana characters
C: bleeding observed in kanji and hiragana characters -Evaluation of Ink Drying Time- The evaluation of ink drying time is performed by observing whether or not ink from an image part is transferred to paper pushed against an image part (solid patch part) immediately after printing. In this case, the time period at which the ability to transfer ink to pushed paper disappears is measured. This time period is evaluated according to the following criteria. "A" and "B" indicate acceptable levels.

A: less than 2 seconds
B: 2 to 5 seconds
C: 5 to 10 seconds
D: 10 seconds or more -See-Through Evaluation- The density on the back surface behind a solid patch part after one day from printing is measured using a X-Rite369 (manufactured by X-Rite). The criteria for evaluation are as follows, and "A" and "B" indicate acceptable levels.

A: less than 0.05
B: 0.05 or more and less than 0.15
C: 0.15 or more

As an electrophotographic recorder, a Fuji Xerox DocuCentreColor400CP is used, and evaluation of image density and transferability is carried out as described below. The results are shown in Table 3.

-Image Density Evaluation-

100% Solid images of magenta are printed in a size of 5 cm×5 cm square using recording papers in the examples and comparative examples after moisten by placing them in an environment of 28° C. and 85% RH for 8 hour or longer. The optical density of the solid image is measured using a X-Rite369 (manufactured by X-Rite). The criteria for evaluation are as follows, and "A" and "B" indicates acceptable levels.

A: 1.5 or more
B: no less than 1.1 and less than 1.5
C: less than 1.1

-Transferability Evaluation-

In image density evaluation, the level of generation of mottled images due to defective toner transfer is observed. The criteria for evaluation are as follows, and "A" indicates an acceptable level.

A: mottling in the density of the image cannot be discerned.
B: mottling of images can be observed slightly with the naked eye.
C: The whole image is mottled.

[Table 3]

As shown in Table 3, when recording paper of the invention is printed by the ink-jet printing machine, there is relatively little feathering and inter-color bleeding if ink containing dye or ink containing pigment is used, compared with when recording paper of the Comparative Examples is used. In addition: the image density is high; the speed of drying is fast; and the see-through density, which is an evaluation index of aptitude for double-sided printing, is also reduced. When the recording paper of the invention is printed by an electrophotographic recorder, there is no generation of defective toner transfer, and the recording paper of the invention can be used in the same manner as conventional recording paper.

TABLE 1

| Recording Paper No. | Cationic Substance Type | Cationic Substance Coated Amount ($g/m^2$) | Heterocyclic Carboxylic Acid Type | Heterocyclic Carboxylic Acid Solubility (g/100 g) | Heterocyclic Carboxylic Acid Coated Amount ($g/m^2$) | Water-soluble Polymer Type | Water-soluble Polymer Coated Amount ($g/m^2$) | Stockigt Sizing Degree (s) | Smoothness (s) | Formation Index | Surface Electric Resistivity(Ω) Volume Electric Resistivity(Ωcm) |
|---|---|---|---|---|---|---|---|---|---|---|---|
| 1 | Calcium Thiocyanate | 1 | Coumarinic acid | 5 | 0.5 | Oxidized starch | 0.7 | 40 | 80 | 30 | $5.0 \times 10^{10}$<br>$3.0 \times 10^{11}$ |
| 2 | Poly(diallyldimethylammonium chloride) | 0.5 | Pyrrolidone carboxylic acid | 7 | 0.5 | Polyacrylic acid | 0.5 | 60 | 100 | 20 | $7.0 \times 10^{10}$<br>$2.2 \times 10^{11}$ |
| 3 | Magnesium Nitrate | 1 | Pyrrole carboxylic acid | 5 | 0.5 | Cation-modified polyvinyl alcohol | 0.5 | 50 | 120 | 40 | $1.5 \times 10^{11}$<br>$6.5 \times 10^{11}$ |
| 4 | Calcium Thiocyanate | 0.5 | Acetic acid (non-Heterocyclic Carboxylic acid) | Complete solubility | 0.07 | Oxidized starch | 1 | 40 | 100 | 30 | $5.0 \times 10^{10}$<br>$1.0 \times 10^{10}$ |
| 5 | No added | | Furan carboxylic acid | 7 | 2 | Oxidized starch | 0.8 | 30 | 120 | 20 | $3.2 \times 10^{11}$<br>$3.5 \times 10^{11}$ |
| 6 | Calcium Thiocyanate | 1 | No added | | | Oxidized starch | 2 | 40 | 65 | 30 | $2.0 \times 10^{11}$<br>$2.0 \times 10^{11}$ |
| 7 | Calcium Formate | 2 | Pyridine pentacarboxylic acid | 10 | 0.5 | No added | | 30 | 70 | 20 | $3.2 \times 10^{8}$<br>$3.5 \times 10^{8}$ |

TABLE 2

| Ink No. | Surface Tension (mN/m) | Elastic modulus (Pa) | Colorant | Type of Anionic Polymer | Acid Value (mg KOH/g) | Neutralization Degree (%) |
|---|---|---|---|---|---|---|
| 1 | 35 | $5.0 \times 10^{-3}$ | Pigment: Black | Styrene/methacrylic acid copolymer | 200 | 20 |
| 2 | 31 | $1.0 \times 10^{-2}$ | Dye: Yellow | Styrene maleic acid/sodium methacrylate copolymer | 100 | 95 |
| 3 | 30 | $2.5 \times 10^{-3}$ | Pigment: Cyan | Styrene acrylic acid/potassium acrylate copolymer | 50 | 95 |
| 4 | 31 | $1.0 \times 10^{-2}$ | Pigment: Magenta | No | — | — |
| 5 | 29 | $1.0 \times 10^{-2}$ | Pigment: Yellow | Styrene maleic acid/sodium methacrylate copolymer | 250 | 95 |
| 6 | 31 | $1.0 \times 10^{-2}$ | Dye: Magenta | Styrene maleic acid/sodium methacrylate copolymer | 35 | 95 |

TABLE 3

| | Paper No. | Ink No. | Inkjet Printing Method: Colorant Type | Image Optical Density | | ICB | Feathering | Drying Time | See-through Density | | Electrophotographic Recording Method: Image Density | Transferability |
|---|---|---|---|---|---|---|---|---|---|---|---|---|
| Example 1 | 1 | 1 | Pigment | 1.50 | A | A | A | A | 0.11 | B | A | A |
| | | 4 | Pigment | 1.00 | B | | B | A | 0.09 | B | | |
| Example 2 | 2 | 2 | Dye | 1.01 | B | A | A | A | 0.03 | A | A | A |
| | | 3 | Pigment | 1.38 | B | | A | A | 0.11 | B | | |
| Example 3 | 3 | 3 | Pigment | 1.48 | B | A | A | A | 0.11 | B | B | A |
| | | 6 | Pigment | 1.40 | B | | A | A | 0.08 | B | | |
| Comparative Example 1 | 4 | 1 | Pigment | 1.38 | B | C | B | A | 0.1 | B | B | A |
| | | 4 | Pigment | 0.92 | C | | C | B | 0.09 | B | | |
| Comparative Example 2 | 5 | 2 | Dye | 1.00 | B | B | C | A | 0.03 | A | A | A |
| | | 3 | Pigment | 1.36 | B | | B | C | 0.18 | C | | |
| Comparative Example 3 | 6 | 3 | Pigment | 1.20 | B | C | C | A | 0.12 | B | A | A |
| | | 6 | Pigment | 1.20 | B | | C | A | 0.12 | B | | |
| Comparative Example 4 | 7 | 1 | Pigment | 1.00 | B | A | A | B | 0.15 | C | A | A |
| | | 2 | Dye | 0.93 | C | | C | B | 0.08 | B | | |
| Comparative Example 5 | 4 | 2 | Dye | 0.90 | C | C | C | B | 0.12 | B | B | A |
| | | 6 | Dye | 0.97 | C | | C | B | 0.19 | C | | |
| Comparative Example 6 | | | | | | | | | | | | |
| Mitsubishi jet laser (plain paper for ink-jet) | | 1 | Pigment | 1.40 | B | A | B | A | 0.13 | B | B | B |
| | | 4 | Pigment | 0.96 | C | | C | A | 0.14 | B | | |

What is claimed is:

1. A recording paper containing pulp fibers and filler as main components and containing in a surface of the recording paper at least one kind of heterocyclic carboxylic acid selected from the group consisting of coumarinic acid, pyrrolidone carboxylic acid, pyrrole carboxylic acid, and pyridine pentacarboxylic acid and a water-soluble polymer, wherein the surface also contains at least one kind of cationic substance selected from the group consisting of a cationic organic molecule and a metal salt containing a metal cation of valency two or greater, and the content per side of the cationic substance in the surface of the base paper is in a range of 0.1 to 3 $g/m^2$ in terms of solid content remaining, and the content per side of the heterocyclic carboxylic acid is in a range of 0.1 to 3 $g/m^2$ in terms of solid content remaining.

2. A recording paper of claim 1 having a base paper containing pulp fibers and filler as main components and produced by applying a treatment solution containing at least a heterocyclic carboxylic acid and a water-soluble polymer onto the surface of the base paper, wherein the treatment solution contains at least one kind of cationic substance selected from the group consisting of a cationic organic molecule and a metal salt containing a metal cation of valency two or greater.

3. A recording paper of claim 2, wherein the recording paper does not have a coated layer containing substantial quantity of pigment formed on either surface thereof, and the treatment solution does not contain substantial quantity of pigment.

4. A recording paper of claim 2, wherein a solubility of the heterocyclic carboxylic acid in 100 g of pure water at 20° C. is no less than 0.1 g and no more than 10 g.

5. A recording paper of claim 4, wherein the solubility is no less than 4 g and no more than 8 g.

6. A recording paper of claim 1, wherein the cationic organic molecule contains a quaternary ammonium group.

7. A recording paper of claim 1, wherein the metal cation of valency two or greater is at least one kind selected from the group consisting of aluminum, beryllium, calcium, magnesium, strontium, barium and radium.

8. A recording paper of claim 2, wherein the mass ratio of the solids content of the cationic substance to that of the heterocyclic carboxylic acid contained in the treatment solution (cationic substance: heterocyclic carboxylic acid) is in a range of 1:5 to 5:1.

9. A recording paper of claim 8, wherein the mass ratio (the cationic substance: the heterocyclic carboxylic acid) is in a range of 2:3 to 3:2.

10. A recording paper of claim 2, wherein the total treatment amount per side of the cationic substance, the heterocyclic carboxylic acid and the water-soluble polymer to the surface of the base paper is in a range of 0.5 to 6 $g/m^2$ in terms of solid content remaining.

11. A recording paper of claim 1, wherein the surface electric resistivity measured after storing at 23° C. and 50% relative humidity for 8 hours or longer is in a range of $1.0\times10^9$ to $1.0\times10^{11}$ Ω.

12. A recording paper of claim 1, wherein the volume electric resistivity measured after storing at 23°C. and 50% relative humidity for 8 hours or longer is in a range of $1.0\times10^{10}$ to $10\times10^{12}$ Ωcm.

13. A recording paper of claim 1, wherein the mass ratio of the solids content of the cationic substance to that of the one kind of heterocyclic carboxylic acid, which is selected from the group consisting of coumarinic acid, pyrrolidone carboxylic acid, pyrrole carboxylic acid, and pyridine pentacarboxylic acid, contained in the treatment solution (cationic substance: heterocyclic carboxylic acid) is in a range of 1:5 to 5:1.

14. An ink-jet image recording method comprising forming an image by applying a droplet of ink containing a colorant and at least one kind of solvent selected from the group consisting of water and a water-soluble organic solvent to a surface of a recording paper containing pulp fibers and filler as main components and containing at least one kind of heterocyclic carboxylic acid selected from the group consisting of coumarinic acid, pyrrolidone carboxylic acid, pyrrole carboxylic acid, and pyridine pentacarboxylic acid and a water-soluble polymer in the surface of the recording paper, wherein the surface of the recording paper also contains at least one kind of cationic substance selected from the group consisting of a cationic organic molecule and a metal salt containing a metal cation of valency two or greater, and the content per side of the cationic substance in the surface of the base paper is in a range of 0.1 to 3 $g/m^2$ in terms of solid content remaining, and the content per side of the heterocyclic carboxylic acid is in a range of 0.1 to 3 $g/m^2$ in terms of solid content remaining.

15. An image recording method of claim 14, wherein the surface tension of the ink is in a range of 20 to 40 mN/in.

16. An image recording method of claim 14, wherein the ink contains an anionic polymer having a hydrophilic part containing hydrophilic group and a hydrophobic part, wherein the hydrophilic group contains a carboxyl group.

17. An image recording method of claim 16, wherein the acid value of the anionic polymer is 30 mgKOH/g or greater but less than 150 mgKOH/g.

18. An image recording method of claim 16, wherein the acid value of the anionic polymer is 150 mgKOH/g or greater, and the degree of neutralization of the anionic polymer is 80% or less.

19. A method for electrophotographically recording an image, comprising:

uniformly charging a surface of an electrostatic latent image support;

exposing the surface of the electrostatic latent image support to light, to thereby form an electrostatic latent image;

developing the electrostatic latent image formed on the surface of the electrostatic latent image support, using an electrostatic image developer, to form a toner image;

transferring the toner image onto a surface of a recording paper containing pulp fibers and filler as main components and containing in a surface of the recording paper at least one kind of heterocyclic carboxylic acid selected from the group consisting of coumarinic acid, pyrrolidone carboxylic acid, pyrrole carboxylic acid, and pyridine pentacarboxylic acid and a water-soluble polymer; and fixing the toner image transferred onto the surface of the recording paper, wherein the surface of the recording paper contains at least one kind of cationic substance selected from the group consisting of a cationic organic molecule and a metal salt containing metal cation of valency two or greater and the content per side of the cationic substance in the surface of the base paper is in a range of 0.1 to 3 $g/m^2$ in terms of solid content remaining, and the content per side of the heterocyclic carboxylic acid is in a range of 0.1 to 3 $g/m^2$ in terms of solid content remaining.

* * * * *